US010293626B2

(12) United States Patent
Strom et al.

(10) Patent No.: US 10,293,626 B2
(45) Date of Patent: May 21, 2019

(54) SELECTABLE DRIVE PRINTING DEVICE

(71) Applicant: Hewlett-Packard Development Company, L.P., Houston, TX (US)

(72) Inventors: Eric Berner Strom, Canby, WA (US); John J Cantrell, Camas, WA (US); Alexander David Laws, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/763,042

(22) PCT Filed: Jan. 15, 2016

(86) PCT No.: PCT/US2016/013620
§ 371 (c)(1),
(2) Date: Mar. 23, 2018

(87) PCT Pub. No.: WO2017/123246
PCT Pub. Date: Jul. 20, 2017

(65) Prior Publication Data

US 2018/0257414 A1 Sep. 13, 2018

(51) Int. Cl.

| | |
|---|---|
| ***B41J 29/393*** | (2006.01) |
| ***B41J 23/02*** | (2006.01) |
| ***B41J 29/38*** | (2006.01) |
| ***B41J 2/165*** | (2006.01) |
| ***B41J 29/02*** | (2006.01) |
| ***B41J 2/175*** | (2006.01) |

(52) U.S. Cl.
CPC ..... *B41J 29/393* (2013.01); *B41J 2/16508* (2013.01); *B41J 2/16511* (2013.01); *B41J 2/175* (2013.01); *B41J 23/025* (2013.01); *B41J 29/02* (2013.01); *B41J 29/38* (2013.01)

(58) Field of Classification Search
CPC ..... B41J 2/16508; B41J 2/16511; B41J 2/75; B41J 23/025; B41J 29/02; B41J 29/38
See application file for complete search history.

(56) References Cited

U.S. PATENT DOCUMENTS

| | | | |
|---|---|---|---|
| 5,712,668 | A | 1/1998 | Osborne et al. |
| 5,980,018 | A | 11/1999 | Taylor et al. |
| 6,309,044 | B1 | 10/2001 | Gaarder |
| 6,398,338 | B1 | 6/2002 | Beng et al. |
| 6,517,269 | B1 | 2/2003 | Scholz et al. |
| 6,814,423 | B2 | 11/2004 | Jefferson et al. |

(Continued)

FOREIGN PATENT DOCUMENTS

| | | |
|---|---|---|
| CN | 1511705 | 7/2004 |
| CN | 1915671 | 2/2007 |

(Continued)

*Primary Examiner* — Lamson D Nguyen
(74) *Attorney, Agent, or Firm* — Fabian VanCott

(57) ABSTRACT

A selectable drive printing device includes a feedshaft to selectively drive a print drive system and a scan drive system, and a shifter to selectively shift a drive selector assembly of the selectable drive printing device between a scanning system drive position wherein the scan drive system is driven and a printing system drive position wherein the print drive system is driven. The shifter is coaxially and rotatably coupled around the feedshaft. Further, the shifter selectively drives the print drive system and the scan drive system based on an angular position of the shifter about the feedshaft.

14 Claims, 23 Drawing Sheets

(56) References Cited

U.S. PATENT DOCUMENTS

| | | | |
|---|---|---|---|
| 7,306,216 | B2 | 12/2007 | Lee et al. |
| 7,527,349 | B2 | 5/2009 | Jung et al. |
| 2004/0099090 | A1 | 5/2004 | Hsu et al. |
| 2006/0175747 | A1 | 8/2006 | Boleda |
| 2008/0179817 | A1 | 7/2008 | Schalk et al. |
| 2009/0174733 | A1 | 7/2009 | Balcan |
| 2009/0174748 | A1 | 7/2009 | Balcan et al. |

FOREIGN PATENT DOCUMENTS

| | | |
|---|---|---|
| EP | 0650843 | 5/1995 |
| EP | 0955168 | 11/1999 |
| EP | 2156960 | 2/2010 |
| WO | WO-9947355 | 9/1999 |
| WO | WO-03018316 | 3/2003 |

SELECTABLE DRIVE PRINTING DEVICE

BACKGROUND

Printing devices provide a user with a hardcopy of a document by printing a representation of the document from digital data onto a print medium. The printing device, such as a two dimensional (2D) printing device, includes a number of components such as a carriage with a number of printheads. The printheads are coupled to the carriage and are used to eject printing fluid or other printable material onto the print medium to form an image. The carriage moves along a carriage rail via a motor to eject the printing fluid onto the print medium to form the image. Further, the printing device may be a 3 dimensional (3D) printing device. The 3D printing device uses printheads to print on a bed of build material to create a 3D object.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1A:
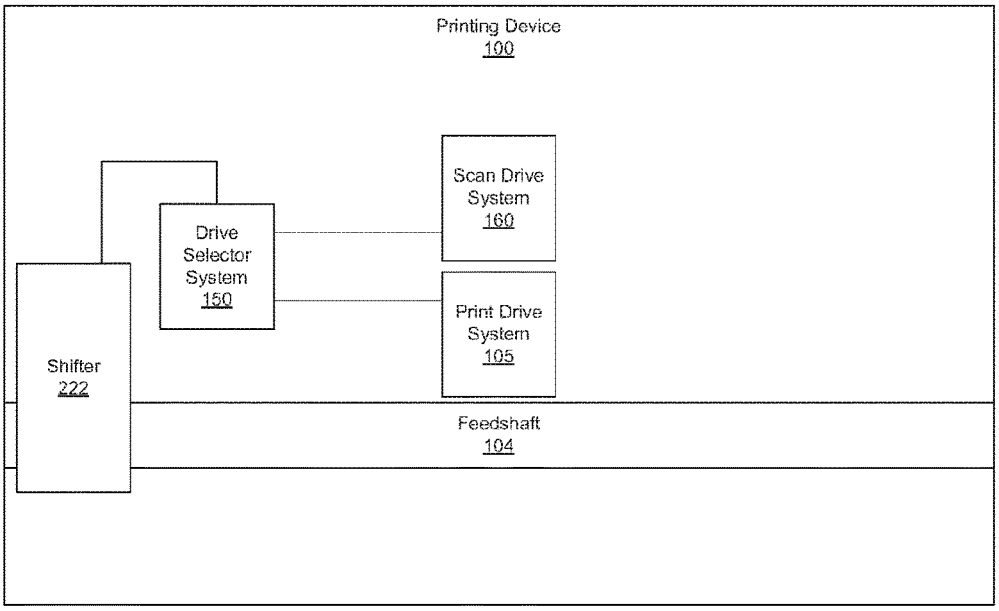
FIG. 1A is a block diagram of a printing device including a drive selector system, according to one example of the principles described herein.

Consumers and marketing departments understand that making products smaller results in a superior product. Some printing devices use one of two mechanisms to cap the printheads. One such mechanism for capping printheads of a printing device is a carriage actuated shifter. Another such mechanism for capping printheads of a printing device is a carriage axis capping system.

In one example, a printing device may use the carriage to actuate a shifter in the X-axis or along a width of the printing device to engage a transmission powered by a paper motor of the printing device. In this example, the printing device relies on a transverse motion in the X-direction or along a width of the printing device to shift the printing device from one state to another state. The paper motor, in this example, drives a capping system to cap a number of printheads of the printing device. However, this type of printing device utilizes the shifter that, when in a free or un-shifted position, takes more space in X direction or along a width of the printing device. This type of shifting takes up between 5 mm and 10 mm of carriage X-direction travel over and above what the printing device uses for printing and servicing of the printheads. Carriage X-directional shifting also comes at the expense of increased carriage torque requirements where the carriage applies force in the X-direction against a shifter return spring.

Reliable carriage X-directional shifting may also be very complex from a firmware algorithms standpoint. For example, for reliable gear engagement, complex routines, retry algorithms, and synchronized motor moves may be used to reliably shift the carriage. Alternatively, some printing devices use the carriage directly to actuate the capping system. This involves the carriage directly pulling the capping body up a set of ramps. This eliminates the need for extra gears and drive system, but may use approximately 15 mm of carriage X-directional travel to accomplish a cap of the printheads.

Examples described herein provide a selectable drive printing device includes a feedshaft to selectively drive a print drive system and a scan drive system, and a shifter to selectively shift a drive selector assembly of the selectable drive printing device between a scanning system drive position wherein the scan drive system is driven and a printing system drive position wherein the print drive system is driven. The shifter is coaxially and rotatably coupled around the feedshaft. Further, the shifter selectively drives the print drive system and the scan drive system based on an angular position of the shifter about the feedshaft. The shifter includes a friction finger formed on the shifter to bias the shifter in a rotational direction of the feedshaft. The selection between the scanning system drive position and the printing system drive position is based at least partially on the rotational direction of the feedshaft effecting a rotational position of the shifter about the feedshaft. The selectable drive printing device further includes a controller to control the operation of the selectable drive printing device. The rotational direction of the feedshaft is controlled by the controller controlling a motor mechanically coupled to the feedshaft.

The shifter includes an arm, wherein the arm interfaces with a carriage of the selectable drive printing device to restrict a rotational position of the shifter in the scanning system drive position. The arm of the shifter also interfaces with a capping system of the selectable drive printing device to restrict a rotational position of the shifter in the printing system drive position.

Examples described herein provide a drive selector assembly for selecting between driving a print drive system and driving a scan drive system. The drive selector assembly includes a feedshaft, and a shifter coaxially and rotatably coupled around the feedshaft. The shifter selectively shifts the drive selector assembly between a scanning system drive position wherein a scan drive system is driven and a printing system drive position wherein a print drive system is driven. The shifter selectively drives the print drive system and the scan drive system based on an angular position of the shifter about the feedshaft.

The drive selector assembly further includes a selector swing arm. The selector swing arm includes a first selector gear meshed with a drive gear coupled to the feedshaft, a second selector gear, and a pivot. The selector swing arm pivots about a pivot point to selectively mesh with a scan drive gear of the scan drive system.

The drive selector assembly further includes a cluster gear. The cluster gear includes a first cluster gear meshed with the feedshaft, and a second cluster gear selectively meshed with a rack. The rack actuates a capping system to cap a number of printheads. A number of idler gears are rotatably coupled to the rack to idle the cluster gear when the cluster gear reaches an end of the rack. The first selector gear is continually meshed with the drive gear. Further, the first cluster gear is continually meshed with the drive gear.

The drive selector assembly further includes a drive swing arm coaxially and rotatably coupled around the feedshaft. The drive swing arm interfaces with the shifter to move a capping system into a capping position when the shifter is in the scanning system drive position.

Examples described herein provide a method for driving a selectable drive system of a printing device. The method includes, with a shifter coaxially and rotatably coupled around a feedshaft and in a scanning system drive position, engaging a drive swing arm coupled around the feedshaft to move a capping system of the selectable drive system to a capping position, and engaging a selector swing arm with a scan drive system.

The method also includes, with the shifter in a printing system drive position, disengaging the selector swing arm from the scan drive system, and disengaging the drive swing arm to move a capping system of the selectable drive system to an uncapped position and drive the printing system. Moving the capping system of the selectable drive system to a capping position includes, with a cluster gear meshed with a drive gear coupled to the feedshaft, engaging a rack to move the rack in a horizontal direction, and with a ramp of the rack, interfacing an oppositely angled elevator of a capping body as the rack moves in the horizontal direction to move the capping body in a vertical direction.

Examples described herein reduce the overall width and footprint of a printing device to an absolute minimum. Other printing device architectures have some amount of extra product width in, for example, the X-axis to allow for a capping system, which, when not in use, is a dead zone for a printing carriage and paper path. Examples described herein allow for a selectable capping drive system when needed, but also allows for the use of that available space for print sweeps during a printing process. Thus, examples described herein use an absolute minimum product width required for printing and servicing, all the while allowing for simplified software and firmware algorithms and lower carriage axis torque requirements. The examples described herein result in a product width reduction of approximately 35 mm over other printing devices.

As used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may not be included in other examples.

Turning now to the figures, FIG. 1A is a block diagram of a printing device (100) including a drive selector system, according to one example of the principles described herein. The selectable drive printing device (100) includes a feedshaft (104) to selectively drive a print drive system (105) and a scan drive system (160), and a shifter (222) to selectively shift a drive selector assembly (150) of the selectable drive printing device (100) between a scanning system drive position wherein the scan drive system (160) is driven and a printing system drive position wherein the print drive system is driven (105). The shifter (222) is coaxially and rotatably coupled around the feedshaft (104). Further, the shifter (222) selectively drives the print drive system (105) and the scan drive system (160) based on an angular position of the shifter (222) about the feedshaft (104). More details regarding the selectable drive printing device (100) will be provided below.

Figure 1B:
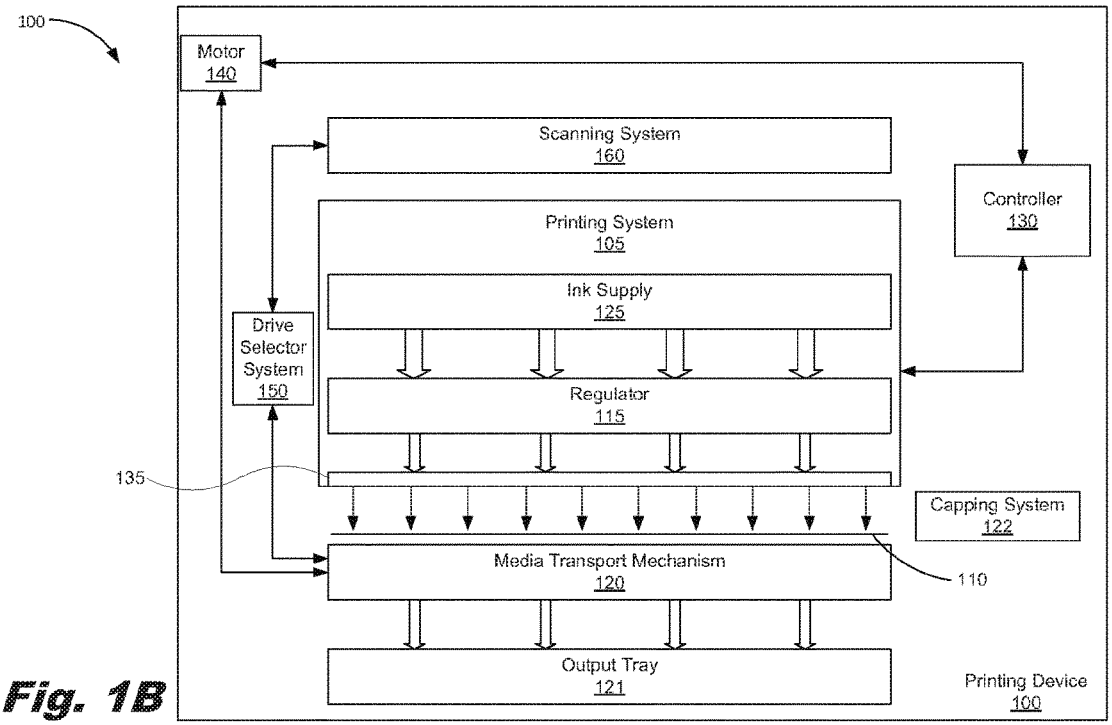
FIG. 1B is a block diagram of a printing device including a drive selector system, according to another example of the principles described herein.

FIG. 1B is a block diagram of a printing device (100) including a drive selector system (150), according to another example of the principles described herein. The printing device (100) may be any type of device that reproduces an image onto a sheet of print media. In one example, the printing device (100) may be an inkjet printing device, laser printing device, a toner-based printing device, a solid ink printing device, a dye-sublimation printing device, or a three-dimensional (3D) printing device, among others. Although the present printing device (100) is described herein as an inkjet printing device, any type of printing device may be used in connection with the described systems, devices, and methods described herein. Consequently, an inkjet printing device (100) as described in connection with the present specification is meant to be understood as an example and is not meant to be limiting.

The printing device (100) may include a number of subsystems that provide, for example, printing and scanning functionality. For example, the printing device (100) includes a printing system (105) that, in one example, includes a carriage moveably coupled to a carriage rail (FIG. 10, 215), and a number of printheads coupled to the carriage. In another example, the printing system (105) may include a number of page wide array printheads. In still another example, the printing system (105) may include a number of three-dimensional (3D) printheads used to build 3D objects. The printing system (105) of the printing device (100) may further include a number of flow regulators (115) associated with the printing system (105), and ink or other ejection fluid supplies (125).

The printing device (100) further includes a media transport mechanism (120) and a motor (114) to drive the media transport mechanism (120). The media transport mechanism (120) may transport media sheets from the printing device to the output tray (121) for collection, registration, and, in some examples, finishing of the media sheets. In one example, the media sheets collected in the output tray (121) include at least one media sheet on which the printing device (100) has produced text and/or images. In one example, a completed collection of media sheets may represent a print job that the printing device processes. Thus, the media transport mechanism (120) is used to transport print media through the printing device (100) during a print operation. The motor (114) also drives the drive selector system (150) and a scanner system (160) included in the printing device (100). In one example, the motor (114) provides rotational movement to a feedshaft of the media transport mechanism (120), and indirectly drives the scanner drive system (125) via the feedshaft and the drive selector system (150).

The drive selector system (150), as will be described in more detail below, is a device that switches between a scanning system (160) drive position that causes the motor (114) to drive the scanning system (160), and a printing system (105) drive position. When the drive selector system (150) is switched to the printing system (105) drive position, it causes the motor (114) to drive the printing system (105) and a capping system (122) used to uncap the printheads (135) of the printing system (105). The mechanisms used to cause the motor (114) to drive the feedshaft of the media transport mechanism (120), and indirectly drive the scanner drive system (125), the printing system (105), and the capping system (122) via the feedshaft and the drive selector system (150) will be described in more detail below.

The capping system (122) is a device that humidically seals the nozzles of the printheads (135) from contaminants and drying when the printing system (105) is not being used to print images on print media (110) fed through the media transport mechanism (120). The scanning system (160) is any device that optically scans documents fed through the scanning system (160) in the Y-direction to produce a digital image. Thus, in one example, the printing device is an all-in-one (AIO) printer/scanner that performs both document printing and document scanning functions.

The printing device (100) further includes a printer controller (130). The controller (130) may represent the programming, processor(s), associated data storage device(s), and the electronic circuitry and components used to control the operative elements of the printing device (100) including the firing and operation of the printheads (135) included in the printing system (105). Still further, the controller (130) controls functions of the motor (114) including, for example, the speed and duration of rotation of the motor (114) that is translated to the feedshaft of the media transport mechanism (120), the direction of rotation translated to the feedshaft of the media transport mechanism (120), the torque output by the motor (114), other functions of the motor, and combinations thereof.

By controlling the motor (114), the controller is able to indirectly control a number of systems within the printing device (100). For example, the controller (130) controls the media transport mechanism (120) used to transport media through the printing device (100) during printing and to transport the media sheets to the output tray (121). Further, the controller (130) controls functions of the scanning system (160), the printing system (105), and the capping system (122) by selectively engaging a shifter (222), a drive swing arm (108), a bearing (203) rotatably coupled to the drive swing arm (108), and other elements of the printing device (100). The controller (130) controls the scanning system (160), the printing system (105), and the capping system (122) by controlling the motor's (114) speed and duration of rotation, the direction of rotation translated, the torque output by the motor (114), other functions of the motor, and combinations thereof.

Throughout the figures, a three-dimensional Cartesian coordinate indicator (280) is depicted to orient the reader as to directions of movement and forces placed on and interaction between the various elements of the printing device (100). For example, the X-direction indicates a width of the printing device (100), the Y-direction indicates the depth of the printing device (100), and the Z-direction indicates the height of the printing device (100). Also, it is noted that throughout the figures, some elements of the printing device (100) may be removed from view in order to facilitate description of the depicted elements and to remove confusion regarding the elements of the printing device (100) described herein.

Figure 2:
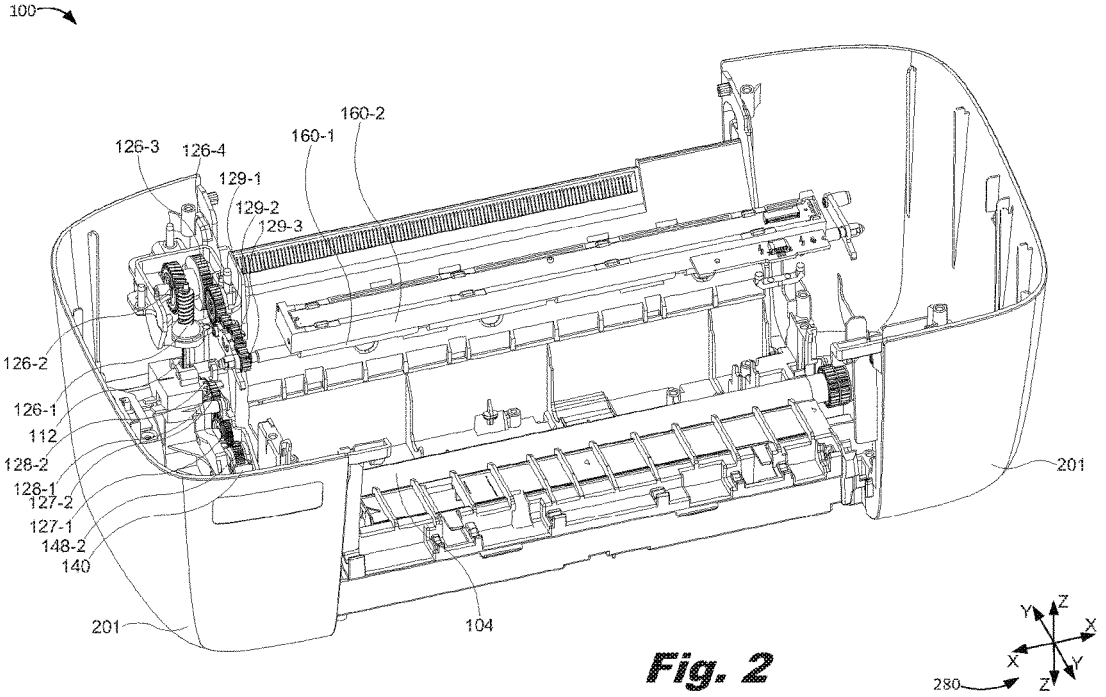
FIG. 2 is an isometric cutaway view of the printing device, according to one example of the principles described herein.
Figure 3:
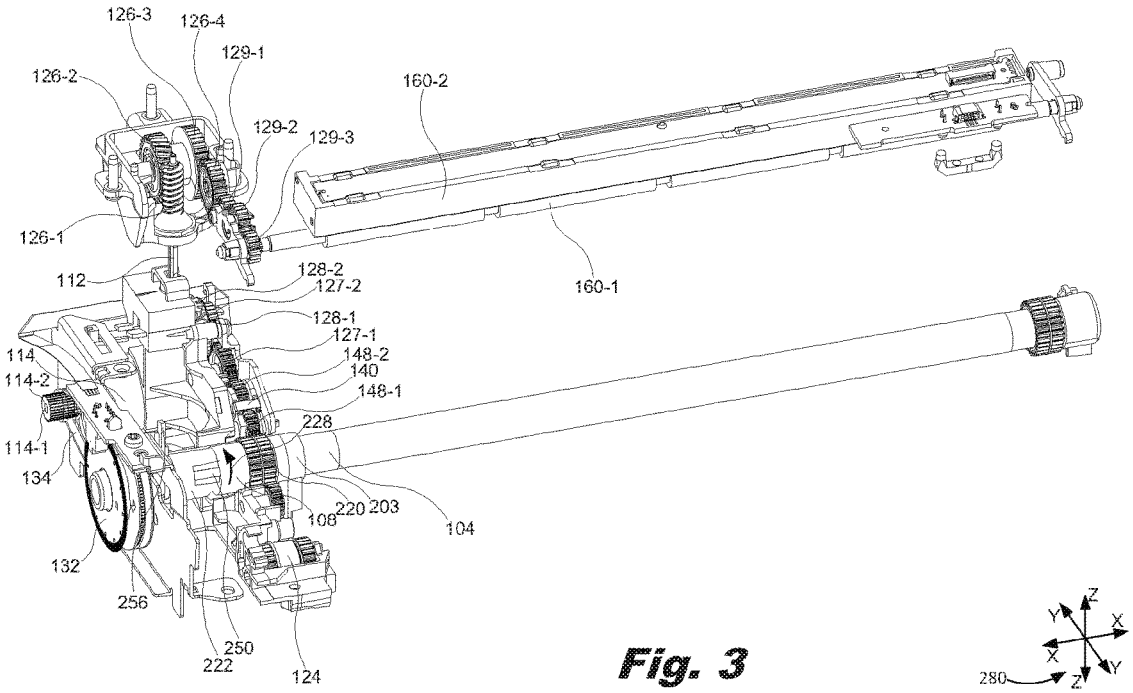
FIG. 3 is an isometric view of the drive system of the printing device including a scan drive system, according to one example of the principles described herein.

Turning now to FIGS. 2 and 3, FIG. 2 is an isometric cutaway view of the printing device (100), according to one example of the principles described herein. Further, FIG. 3, is an isometric view of the drive system of the printing device including a scan drive system, according to one example of the principles described herein. FIG. 2 depicts the printing device (100) with a portion of a housing (201) removed or cutaway to depict number of elements of the printing device (100). FIG. 3 depicts the elements of the printing device (100) included within the housing (201) depicted in FIG. 2. Reference will now be made to both FIGS. 2 and 3.

The printing device (100) includes a motor (114). The motor (114) includes a drive shaft (114-1) and a drive shaft gear (114-2). A toothed belt (134) is meshed with and coupled to the drive shaft gear (114-2) and a drive pulley (132). The drive pulley (114-4) is coupled to a feedshaft (104), and due to the rotation of the motor's (114) drive shaft (114-1) and drive shaft gear (114-2), and the resulting movement of the toothed belt (114-3) and rotation of the drive pulley (114-4), the feedshaft (104) rotates. In one example, if the motor (114) rotates in a forward direction, the feedshaft (104) rotates clockwise relative to the views of the feedshaft (104) in, for example, FIGS. 4-7. If the motor (114) rotates in a reverse direction, the feedshaft (104) rotates counter clockwise relative to the views of the feedshaft (104) in, for example, FIGS. 4-7. In one example, the motor (114) provides sufficient torque to drive the components of the printing device (100) and components connected to the printing device (100).

The feedshaft (104) is used to impart rotational movement to the printing system (105). This rotational movement causes the printing device (100) to feed sheets of print media through the printing device (100) in the Y-direction, engages and disengages the capping system (122), and causes the printing device (100) to feed documents through the scanning system (160) to create digital representations of the documents.

The feedshaft (104) includes a number of elements fixedly coupled and rotatably coupled to the feedshaft (104). Feedshaft drive gears (120) are formed in or coupled to the feedshaft (104) and move with the feedshaft (104) as the feedshaft (104) turns. Further, a drive swing arm (108) and a bearing (203) are rotatably coupled to the feedshaft (104) such that the feedshaft (104) rotates and the drive swing arm (108) and a bearing (203) do not rotate with the feedshaft (104).

A shifter (222) is rotatably coupled to the feedshaft (104) such that the shifter (222) is free to rotate about the feedshaft (104). The shifter (222) includes a friction finger (250) formed therein. The friction finger (250) creates an amount of drag on the feedshaft (104). This drag produced by the friction finger (250) ensures that the shifter (222) biases itself in the direction of rotation of the feedshaft (104). In this manner, the shifter (222) is able to be repositioned and selectively engage and disengage with the drive swing arm (108) based on a direction of rotation of the feedshaft (104). It is noted that the direction of rotation of the feedshaft (104) is based on the direction of rotation of the motor (114), and that the direction of rotation of the motor (114) is based on the signals received from the controller (130).

The shifter (222) either places the printing device (100) in a printing and uncapped state or in a scanning and capped state based on the direction of rotation of the feedshaft (104). Here, "capped state" refers to the capping system (122) capping the printheads (135) of the printing system (105), and "uncapped state" refers to the capping system (122) disengaging the caps (271) from the printheads (135). Thus, the shifter (222) is the device within the printing device (100) that causes, at least partially, the printing device to be either in a scanning system (160) drive position that causes the motor (114) to drive the scanning system (160), or a printing system (105) drive position that causes the motor (114) to drive the printing system (105).

In one example, the capping system (122) caps the printheads (135) of the printing device (100) when the shifter (222) is in the scanning system (160) drive position and uncaps the printheads (135) of the printing device (100) prior to and when the shifter (222) is in the printing system (105) drive position to allow the printheads of to be used by the printing system (105). Further, the shifter (222) is influenced by the positioning of other components within the printing device (100). For example, a carriage used to carry the printheads (135) as they eject printing fluid prevents the shifter (222) from over rotating about the feedshaft (104) when the shifter (222) is in a scanning system drive position. In this state, a rack (FIGS. 4 and 5, 118) is in a scan position as well, and the printheads (135) are capped. Conversely, when the rack (FIGS. 4 and 5, 118) is in an uncapped position, the printheads (135) are uncapped, and the shifter (222) is oriented in a printing system drive position. More information regarding the interaction between the function of the shifter (222), the rack (118), and the capping system (122) is described below.

A drive selector system (150) and a scan drive system of the printing device (100) will now be described in connection with the feedshaft (104). The feedshaft (104), driven by the motor (114), provides rotational power and torque to both the printing system (105) and the scanning system (160). However, selection of which of the printing system (105) and the scanning system (160) to drive is at least partially based on the position of a selector swing arm (140). A feedshaft drive gear (220) formed on or coupled to the feedshaft (104) meshes with the first selector gear (148-1). In one example, the feedshaft drive gear (220) is continually meshed with the first selector gear (148-1) during all operation states of the printing device (100).

Figure 7:
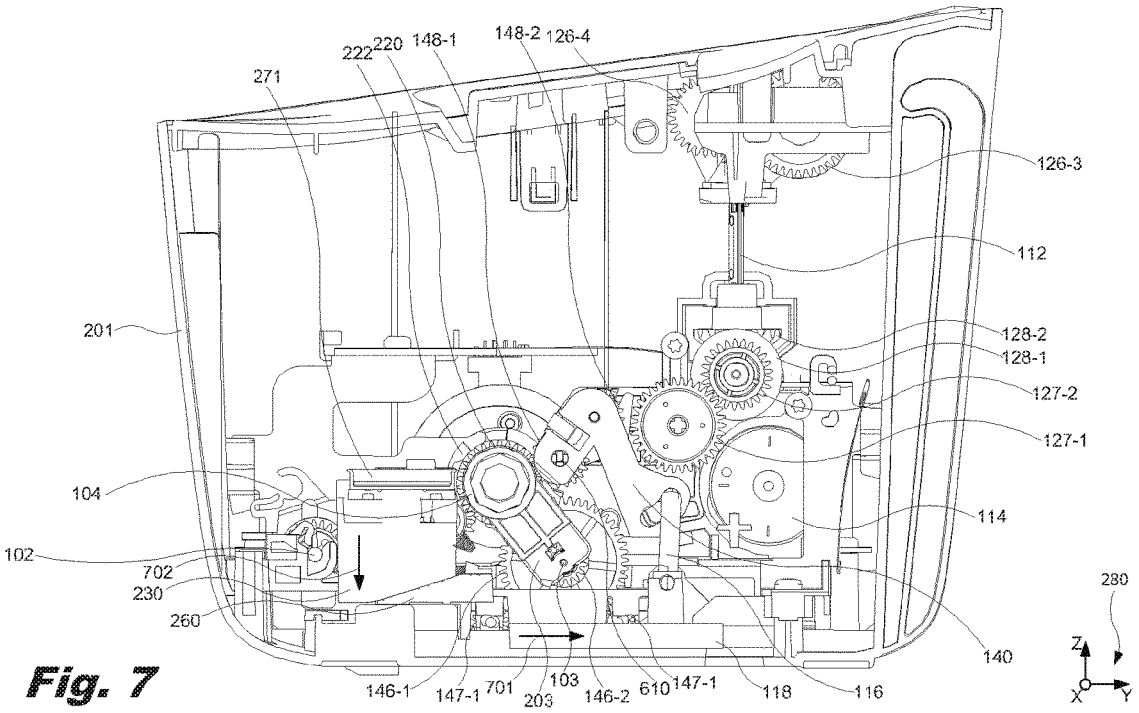
FIG. 7 is a side cutaway view of the printing device with a scan drive of the printing device disengaged, according to one example of the principles described herein.
Figure 8:
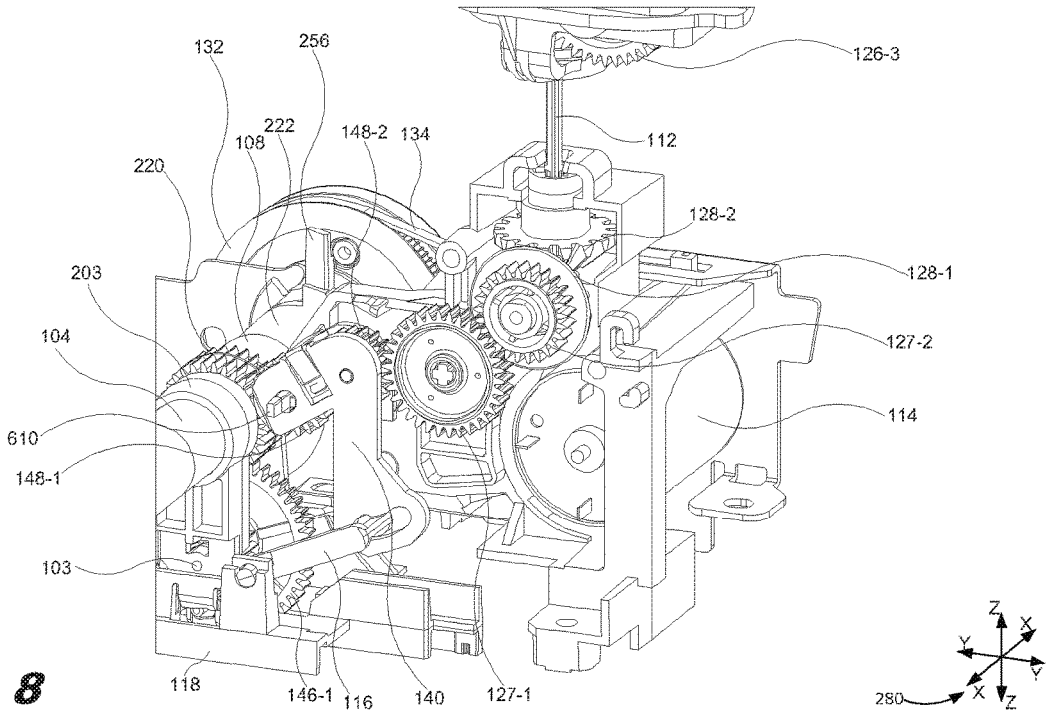
FIG. 8 is a partially cutaway, isometric view of the printing device with a scan drive of the printing device engaged, according to one example of the principles described herein.
Figure 9:
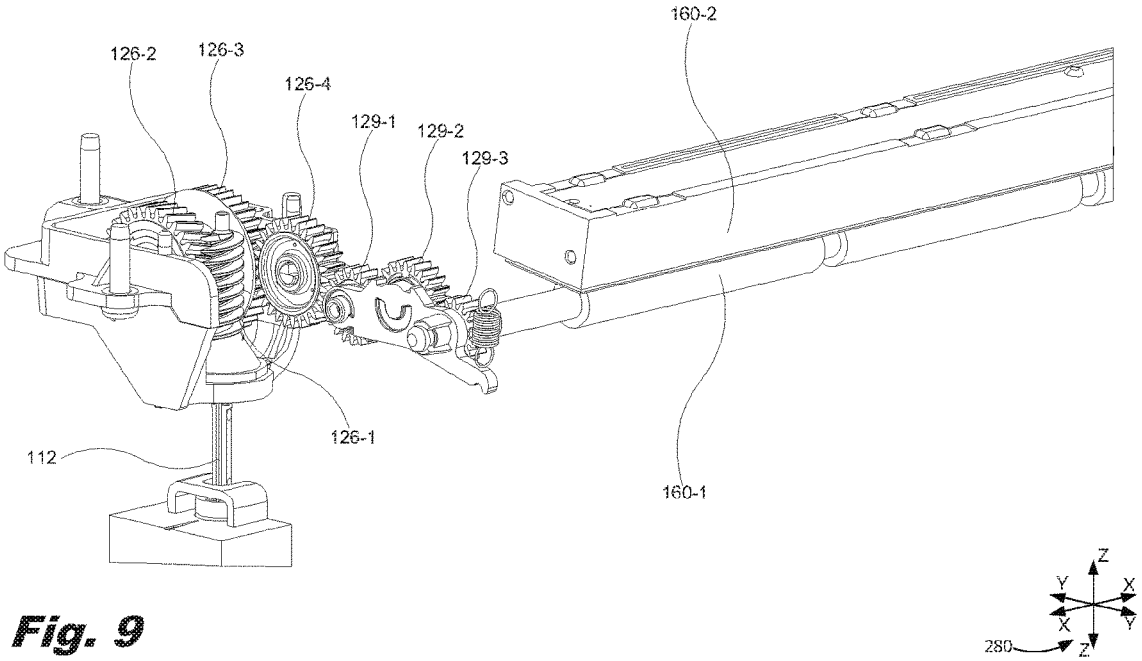
FIG. 9 is an isometric view of the scan drive system of FIG. 5, according to one example of the principles described herein.

In FIGS. 2 and 3, as well as FIGS. 7 and 8, the selector swing arm (140) is in a scanning drive position. In this position, the teeth of the second selector gear (148-2), being engaged with the first selector gear (148-1) and driven by the feedshaft drive gear (220), engage with the teeth of the a first intermediate gear (127-1) and the remaining movement components of the scanning system (160). The components of the scanning system (160) will now be described in the order at which movement and torque is imparted.

Specifically, the first intermediate gear (127-1) meshes with a second intermediate gear (127-2) formed on the first bevel gear (128-1). In the example of FIGS. 2 and 3, the system includes two intermediate gears (127-1, 127-2) in order to maintain an intended direction of rotation and to adjust torque and gear ratios. However, any number of intermediate gears may be employed.

The second intermediate gear (127-2) may be formed with or otherwise coupled to a first bevel gear (128-1). In this manner, the second intermediate gear (127-2) and the first bevel gear (128-1) form a gear cluster. A gear cluster is any assembly of gears permanently attached to a shaft or formed as a monolithic set with a common axis. The second intermediate gear (127-2) formed on the first bevel gear (128-1) being meshed with the first intermediate gear (127-1) is caused to rotate. This actuates the first bevel gear (128-1) portion of the combination of the second intermediate gear (127-2) and first bevel gear (128-2). The first bevel gear (128-1) meshes with the second bevel gear (128-2).

Again, the movement of the intermediate gears (127-1, 127-2) and the bevel gears (128-1, 128-2) are effected by rotation of the feedshaft (104) when the selector swing arm (140) is in a scanning drive position. As a result, the motor (114) is able to drive the components of the scanning system (160) via the feedshaft (104) and the selector swing arm (140). In contrast, the intermediate gears (127-1, 127-2) and the bevel gears (128-1, 128-2) of the scanning system (160) disengage from the feedshaft drive gear (220) of the feedshaft (104) when the second selector gear (148-2) of the selector swing arm (140) is disengaged from the first intermediate gear (127-1). As will now be described in more detail, this state also includes the rack (118) of the drive selector system (150) being in an uncapped position.

Figure 4:
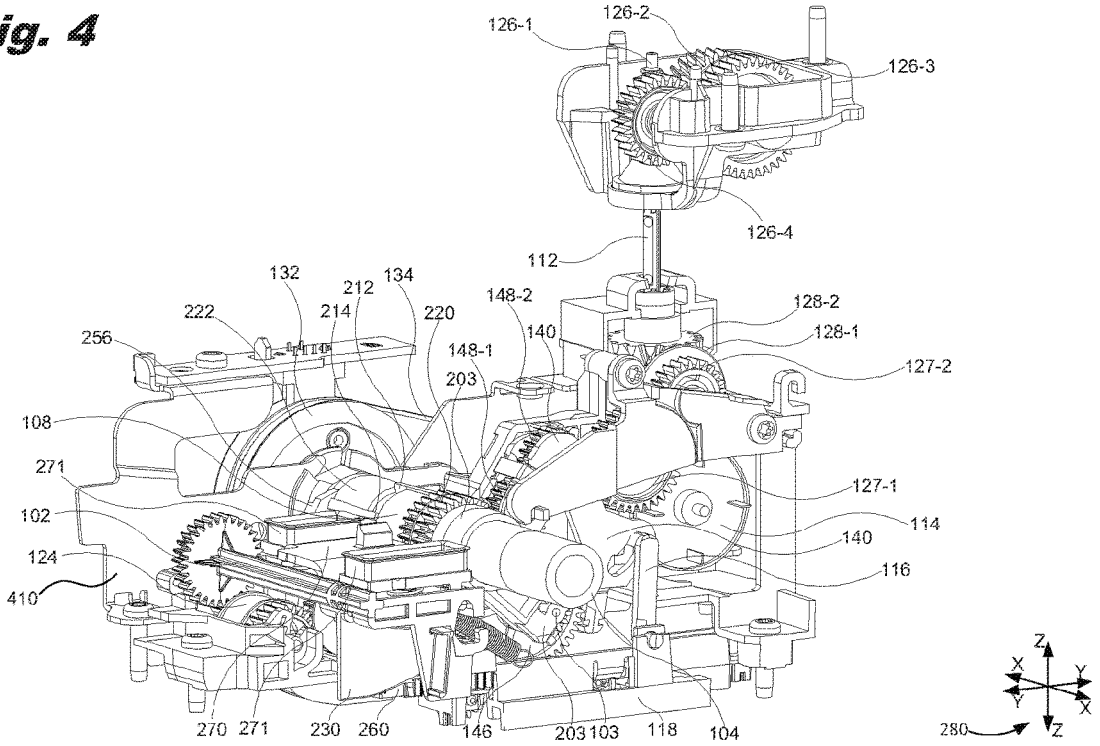
FIG. 4 is a partially cutaway, isometric view of a drive system of the printing device, according to one example of the principles described herein.
Figure 5:
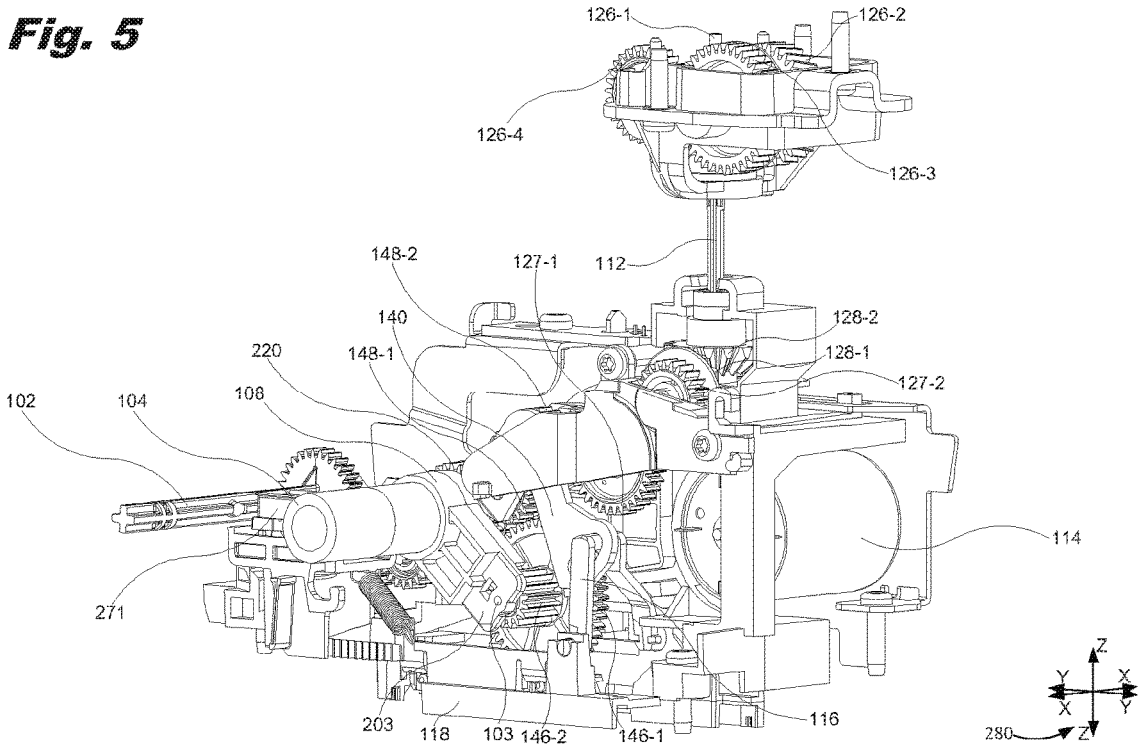
FIG. 5 is a partially cutaway, isometric view of a drive system of the printing device, according to one example of the principles described herein.
Figure 6:
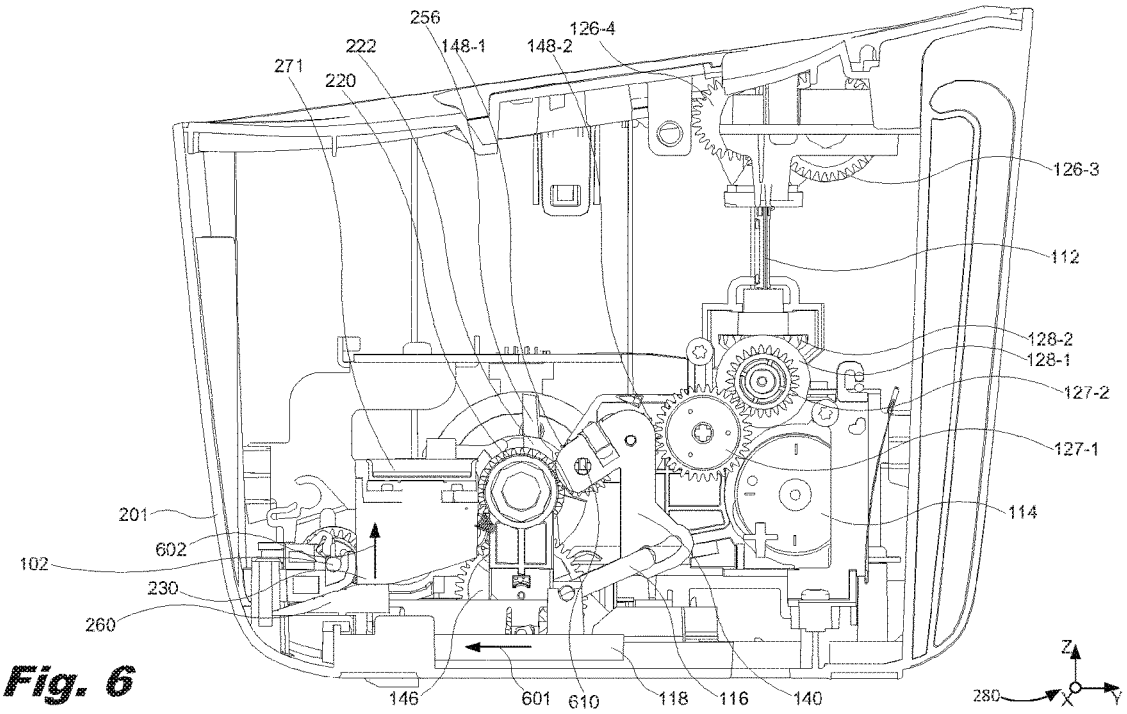
FIG. 6 is a side cutaway view of the printing device with a scan drive of the printing device engaged, according to one example of the principles described herein.

The pivoting movement of the selector swing arm (140) and the lateral movement of the rack (118) will now be described in connection with FIGS. 4 through 7. FIG. 4 is a partially cutaway, isometric view of a drive system of the printing device (100), according to one example of the principles described herein. Further, FIG. 5 is a partially cutaway, isometric view of a drive system of the printing device (100), according to one example of the principles described herein. FIGS. 4 and 5 are two different perspectives of the drive system of the printing device (100). Further, FIG. 6 is a side cutaway view of the printing device (100) with a scan drive of the printing device (100) engaged, according to one example of the principles described herein. In contrast, FIG. 7 is a side cutaway view of the printing device (100) with the scan drive of the printing device (100) disengaged, according to one example of the principles described herein.

The disengagement of the second selector gear (148-2) of the selector swing arm (140) from the first intermediate gear (127-1) to cause the printing device (100) to stop driving the scanning system (100) is brought about via the interaction between the shifter (222), the drive swing arm (108), and the bearing (203) coupled to the drive swing arm (108). Specifically, the shifter (222) includes a shifter interface (FIG. 4, 214) that selectively interfaces with a swing arm interface (FIG. 4, 212) of the drive swing arm (108) as depicted in, for example, FIG. 4. As depicted in, for example, FIG. 3, the arm (256) of the shifter (222) is in an up position which indicates that the shifter interface (FIG. 4, 214) is interfacing with the swing arm interface (FIG. 4, 212) of the drive swing arm (108), and causing the drive swing arm (108) to move to and remain in a position as indicated by arrow 228 in FIG. 3. Thus, the shifter (222) interfaces with the drive swing arm (108) as the feedshaft (104) rotates in the same direction as arrow 228 as depicted in FIG. 3.

The drive swing arm (108) is coupled to the bearing (203) via, for example a swing arm rod (FIGS. 4 and 5, 103). In this manner, the drive swing arm (108) and the bearing (203) move together as they rotate about the feedshaft (104) based on the interaction between the shifter (222) and the drive swing arm (108).

The drive swing arm (108) and the bearing (203) move together since they are coupled together via the swing arm rod (103). In one example, if the drive swing arm (108) rotates counter clockwise as a result of the interface between the shifter (222) and the drive swing arm (108), the bearing (203) rotates counter clockwise with the drive swing arm (108). Conversely, if the drive swing arm (108) rotates clockwise as a result of the disengagement of the interface between the shifter (222) and the drive swing arm (108), the bearing (203) rotates clockwise.

This, in turn, allows the drive swing arm (108) to swing between two positions such that the cluster gears (FIGS. 4 and 5, 146-1, 146-2) can engage or disengaged from teeth defined in the rack (118). Specifically, the cluster gear (146) is coupled to the swing arm rod (103) between the drive swing arm (108) and the bearing (203), and includes a first cluster gear (146-1) and a second cluster gear (146-2) as depicted in FIGS. 5 and 7, for example. The first cluster gear (146-1) is larger than the second cluster gear (146-2). Further, the first cluster gear (146-1) is connected to the second cluster gear (146-2) on either a common shaft, or as a monolithic set. The teeth of the first cluster gear (146-1) engage with teeth of the feedshaft drive gear (220). As a result, as the feedshaft drive gear (220) rotates, the rotational motion is transferred to the first cluster gear (146-1). The second cluster gear (146-2) engages or disengages with the teeth of the rack (118) depending on the position of the drive swing arm (108). When the second cluster gear (146-2) engages with the rack (118), the rotational motion of the second cluster gear (146-2) is transferred to a linear motion of the rack (118). As a result, the rack (118) moves laterally between the scanning system (160) drive position that causes the feedshaft (104) to drive the scanning system (160), and the printing system (105) drive position that causes the feedshaft (104) to drive the printing system (105). The difference between the scanning system (160) drive position and the printing system (105) drive position is depicted in FIGS. 6 and 7, respectively.

With the understanding of how the cluster gear (146) moves the rack (118), the drive selector system (150) includes a connector arm (116). The connector arm (116) is pivotally connected to the rack (118) and to the selector swing arm (140). As the position of the rack (118) changes, the position of the connector arm (116) changes. For example, when the rack (118) is in the scanning system (160) drive position as depicted in, for example, FIGS. 6 and 8, the connector arm (116) is in a relatively horizontal position. This causes the selector swing arm (140) to pivot about an axis (610) on which the selector swing arm (140) is coupled. With this pivoting about the axis, (610), the selector swing arm (140) places the printing device (100) in the scanning system (160) drive position and causes the second selector gear (148-2) to mesh with the first intermediate gear (127-1). With the second selector gear (148-2) engaged with the first intermediate gear (127-1), the rotation of the feedshaft drive gear (220) coupled to the feedshaft (104) imparts rotational movement to the first intermediate gear (127-1) and the remainder of the scanning system (160).

In contrast, when the rack (118) is in the printing system (105) drive position, as depicted in, for example, FIGS. 4, 5, and 7, the connector arm (116) is in a relatively vertical position. This pivots the selector swing arm (140) about the axis (610) to the printing system (105) drive position, and causes the second selector gear (148-2) to disengaged from the first intermediate gear (127-1). In this state, the first selector gear (148-1) and the second selector gear (148-2) are in neutral and simply rotate without transmitting movement or torque to any other portion of the printing device (100). Thus, as the position of the connector arm (116) changes, the selector gears (148-1, 148-2) of the selector swing arm (140) engage or disengage with the scanning system (160).

The printing device (100) as described thus far is a compact design that uses a single motor to drive components of a scanning system (160), components to cap and uncap printheads (135) using the capping system (122) of the printing device (100), and drive components of the printing system (105). As a result, by eliminating a dedicated motor to drive components of the scanning system (160) and another motor to drive components of a capping system (122), and instead using a single motor to drive for the scanning system (160), the capping system (122), and the printing system (105), the overall size, weight, and cost of the printing device (100) is significantly reduced. In one example, the overall size of the printing device is reduced by approximately 35 millimeters (mm). Further, the reduction in manufacturing cost of the printing device (100) may be approximately $1.00 U.S. dollar or more.

Thus, the printing device (100) includes a capping system (122), a scanning system (160), and a drive selector system (150). The drive selector system (150) includes a number of components including the shifter (222), the bearing (203), the drive swing arm (108), and selector swing arm (140) as described above. Further, the controller (130) and the motor (114) serve to rotate the feedshaft (104) in either direction to influence the function and position of the shifter (222), the bearing (203), the drive swing arm (108), and selector swing arm (140), and, in this manner, may also be considered part of the drive selector system (150). The printing device (100) uses a single motor (114) to drive all these systems.

Turning again to the scanning system (160), the shifter (222), the bearing (203), the drive swing arm (108) of the drive selector system (150) cause the selector swing arm (140) to engage or disengage the scanning system (160) from the feedshaft. The scanning system (160) includes a number of components including, in order of transmitted torque, the first and second intermediate gears (127-1, 127-2), and the first and second bevel gears (128-1, 128-2) described above. The scanning system (160) further includes a PTO shaft (112), a worm (126-1) and a worm gear (126-2) forming a worm gear set, third and fourth intermediate gears (126-3, 126-4), fifth and sixth intermediate gears (129-1, 129-2), and a scan roller gear (129-3) coupled to a scan roller (160-1). The scanning system (160) further comprises an optical scanning device (160-2) to scan documents fed in the Y-direction by the scan roller (160-1).

In one example, the PTO shaft (112) is used to connect the set of bevel gears (128-1, 128-2) and the worm (126-1) to each other. As mentioned above, the first bevel gear (128-1) and the second bevel gear (128-2) are set perpendicular to bring about a 90-degree transfer of motion from the X- and Y-direction to the Z-direction so that the torque is transferred in an upward direction. As a result, the teeth on the first bevel gear (128-1) and the teeth on the second bevel gear (128-2) are designed to engage with each other at a 90-degree angle. This transfers the motion in the Z-direction relative to the X- and Y-directions. The second bevel gear (128-2) is coupled to or formed with a first end of the PTO shaft (112).

The PTO shaft (112) drives the worm drive (110) depicted in, for example, FIGS. 2-7 and 9. In more detail, the PTO shaft (112) is coupled to or formed with the worm (126-1). The worm (126-1) and a meshing worm gear (126-2) are set perpendicular to each other. As a result, the teeth on the worm (126-1) and the teeth on the worm gear (126-2) are designed to engage with each other at a 90-degree angle. This allows the worm gear (126-2) to rotate as the worm (126-1) rotates and provides a 90-degree transfer of motion in the plan based on the Cartesian coordinate indicator (280). The worm gear (126-2) is axially connected to or formed with a third intermediate gear (126-3). As a result, as the worm gear (126-2) rotates, the third intermediate gear (126-3) rotates in the same rotational direction. The third intermediate gear (126-3) meshes with a fourth intermediate gear (126-4), and the fourth intermediate gear (126-4) is used to drive a number of components of the scanning device including, for example, the fifth and sixth intermediate gears (129-1, 129-2), and the scan roller gear (129-3) coupled to the scan roller (160-1).

The bevel gears (128) of the scanning system (160) engage with the feedshaft drive gear (220) of the feedshaft (104) when the rack (118) of the of the drive selector system (150) is in a scanning system (160) drive position designed by arrow 601 of FIG. 6, for example. A second selector gear (148-2) rotatably coupled to the selector swing arm (140) is meshed with the first intermediate gear (127-1) when the drive selector system (150) is positioned in the scan position. A first selector gear (148-1) remains meshed with the feedshaft drive gear (220) when the selector swing arm (140) is in any position including the capped and scan position and the uncapped and printing position. The teeth of the bevel gears (128) engage with teeth of selector gears (148-1, 148-2) of a selector swing arm (140) when the rack (118) of the drive selector system (150) is in the scan position. As depicted in FIG. 6A for example, with the rack (118) in the scan position, the selector swing arm (140) is in a scanning drive position. Further, the teeth of the first selector gear (148-1) engage with the teeth of the feedshaft drive gear (220) as well as the first intermediate gear (127-1). The first intermediate gear (127-1) meshes with a second intermediate gear (127-2) formed on the first bevel gear (128-1). In this manner, the second intermediate gear (127-2) and the first bevel gear (128-1) form a gear cluster. A gear cluster is any assembly of gears permanently attached to a shaft or formed from as a monolithic set with a common axis.

The second intermediate gear (127-2) formed on the first bevel gear (128-1) being meshed with the first intermediate gear (127-1) is caused to rotate. This actuates the first bevel gear (128-1) portion of the combination of the second intermediate gear (127-2) and first bevel gear (128-2). The first bevel gear (128-1) meshes with the second bevel gear (128-2). Again, the movement of the intermediate gears (127-1, 127-2) and the bevel gears (128) are caused by rotation of the feedshaft (104) when the rack (118) of the drive selector system (150) is in the scanning system (160) drive position as depicted in FIGS. 3, 6, and 8. In contrast, the first intermediate gear (127-1) and the remainder of the gears within the scanning system (160) disengage from the feedshaft drive gear (220) of the feedshaft (104) when the rack (118) of the drive selector system (150) is in a printing system (105) drive position. For example, the teeth of the first intermediate gear (127-1) disengages from the teeth of the second selector gear (148-2) when the rack (118) of the drive selector system (150) is in the printing system (105) drive position as depicted in, for example, FIGS. 4, 5, and 7. With the rack (118) in the printing system (105) drive position, the selector swing arm (140) is pivoted about the axis (610) on which the selector swing arm (140) is coupled. In this state, arm (256) of the shifter (222) is in a down position which indicates that the shifter interface (FIG. 4, 214) is not interfacing with the swing arm interface (FIG. 4, 212) of the drive swing arm (108). Instead, the drive swing arm (108) is allowed to move to and remain in a position opposite the direction indicated by arrow 228 in FIG. 3. As described above, the drive swing arm (108) and the bearing (203) move together since they are coupled together via the swing arm rod (103). This, in turn, allows the feedshaft drive gear (220) to rotate as the feedshaft (104) rotates, and transfer the rotational motion to the first cluster gear (146-1). The second cluster gear (146-2) again engages with the teeth of the rack (118), and the rotational motion of the second cluster gear (146-2) is transferred to a linear motion of the rack (118) in the direction opposite the direction of arrow 601 depicted in FIG. 6. As a result, the rack (118) moves laterally between the scanning system (160) drive position that causes the feedshaft (104) to drive the scanning system (160), to the printing system (105) drive position. As a result, the motor (114) is not able to drive the scanning system (160) and, in turn, the components of the scanning device, due to the disengagement of the selector swing arm (140) from the connector arm (116) pivotably coupled to the rack (118) pushing the selector swing arm (140) out of engagement with the first intermediate gear (127-1) as depicted in, for example, FIGS. 4, 5, and 7.

Turning now to additional components of the printing device (100) other than the scanning system (160), the printing device (100) also includes an output shaft (102). The output shaft (102) is used to drive the printing media out of the printing device (100) in the Y-direction and into, for example, the output tray (121) at the last stage of printing. The output shaft (102) is connected to and driven by the feedshaft (104) via a one-way clutch (124). The one-way clutch is driven by the feedshaft drive gear (220). The one-way clutch (124) engages the output shaft (102) when the feedshaft (104) rotates in one direction. However, the one-way clutch (124) does not engage the output shaft (102) when the feedshaft rotates in an opposite direction. For example, if the feedshaft (104) rotates counter-clockwise as depicted in, for example FIGS. 6 and 7, the output shaft (102) also rotates counter-clockwise to output the print media. However, if the feedshaft (104) rotates clockwise, the output shaft (102) does not rotate. It is noted that the rotational direction of the feedshaft (104) and effected rotation of the output shaft (102) may be in any direction that brings about the ejection of print media. With this understanding, the print media moves away from the printing device such that print media is ejected from the printing device during a printing operation, and the output shaft (102) does not allow the print media to move back into the printing device (100).

In some examples, printing devices have an output drive system, such as the output shaft (102) and the one-way clutch (124), located in relatively different locations in the printing device than other components of the printing device. However, the components of the printing device (100) of the examples described herein, including the capping system (122), are located in relatively the same location as the output drive system. In other printing devices, since space is limited, a capping system (122) that can move up and down, side to side, and back and forth, cannot be used with the printing device (100) in proximity to the output drive system. However, examples described herein provide the capping system (122) that moves up and down as described above. This allows the capping system (122) and the output system to be located in relatively the same location within the printing device or juxtaposition one another as described herein.

Further, with reference to FIGS. 4-7, the printing device (100) includes a capping system (122). The capping system (122) is used to cap and humidically seal a number of printheads coupled to a carriage that provides motion of the printheads in the X-direction. The capping system (122) includes at least a portion of the rack (118). In this manner, the motion of the rack (118) as described herein effects the capping and uncapping of the capping system (122) relative to the printheads. The rack (118) includes a ramp (260) formed therein that interfaces with an elevator (230) formed in the capping body (270).

As depicted throughout the figures, the capping system (122) is located underneath other components of the printing device (100). For example, the capping system (122) is located underneath the feedshaft (104) and the output shaft (102). Due to the design of the capping system (122) and its proximity to the other components. The capping system (122) is able to travel up and down as described above without interfering with the operation of other components.

The capping system (122) further includes a number of caps (271) formed on the capping body (270). In one example, the number of caps (271) is equal to the number of printheads (135) that may be coupled to the carriage. The ramp (260) formed on the rack (118) of the capping system (122) moves the elevator (230). For example, the elevator (230) moves in a vertical direction as indicated by arrow 602 and 702 in FIGS. 6 and 7, respectively, as the rack (118) and its ramp (260) move in a horizontal direction as indicated by arrows 601 and 701, respectively.

The printing device (100) is in a printing system (105) drive position as depicted in FIGS. 4 and 7. Further, the shifter (222) is in a clear position. In the clear position, the arm (256) of the shifter (222) rotates from an up, scanning system (160) drive position to the clear position when the feedshaft (104) rotates counter-clockwise as depicted in FIG. 7. In the clear position, the arm (256) of the shifter (222) does not interface with a carriage. As a result, the carriage is free to move in the X-direction along the carriage rail (FIG. 10, 215) to which it is coupled.

Once the printing device (100) has finished a print job, the printheads of the printing device (100) are capped in order to humidically seal the nozzles of the printheads from contaminants and drying when the printing device is not being used to print images on print media. In one example, the feedshaft (104) rotates clockwise relative to the view depicted in FIGS. 6 and 7. This moves the shifter (222) to a scanning system (160) drive position. In the scanning system (160) drive position, the drive arm interface (212) interfaces with the shifter interface (214). This causes the drive swing arm (108) and the bearing (203) to swing clockwise relative to the view depicted in FIGS. 6 and 7. The cluster gears (146-1, 146-2) rotatably coupled to the drive swing arm (108) engage with the rack (118) when the rack (118) is in the uncapped position as depicted in FIG. 7.

The second cluster gear (146-2) as depicted in FIGS. 6 and 7 is depicted as being meshed with a first idler gear (147-1) that is rotatably coupled to a portion of the rack (118) on the left or in the negative X-direction. An idler gear is any gear that does not drive a shaft to perform any work. In the case of the first idler gear (147-1), its function is to allow the second cluster gear (146-2) to idle after a transition of the rack (118) from the left to the right as depicted in the transition between FIG. 7 to FIG. 6 since the cluster gears (146-1, 146-2) are continually meshed with the feedshaft drive gear (220). In this example, the cluster gears (146-1, 146-2), once meshed with either of the idler gears (147-1, 147-2), is in a neutral state wherein the cluster gears (146-1, 146-2) cannot do any work. The cluster gears (146-1, 146-2) will stop spinning if the feedshaft (104) stops turning, and are caused to rotate when the feedshaft (104) resumes rotating. Further, the cluster gears (146-1, 146-2) rotate in a direction opposite the feedshaft (104).

In preparing to cap the printheads coupled to the carriage, the friction finger (250) biases the shifter (112) to rotate in the same direction as the rotation of the feedshaft (104). As mentioned above, the friction finger (250) creates an amount of drag on the feedshaft (104). This drag produced by the friction finger (250) ensures that the shifter (222) always biases itself in the direction of rotation of the feedshaft (104). In this manner, the shifter (222) is able to be repositioned and selectively engage and disengage with the drive swing arm (108) based on a direction of rotation of the feedshaft (104). It is noted that the direction of rotation of the feedshaft (104) is based on the direction of rotation of the motor (114), and that the direction of rotation of the motor (114) is based on the signals received from the controller (130).

The shifter (222) rotates with the feedshaft (104) until it interfaces with a portion of the printing device (100) including, for example, the carriage or the capping body (270). Once the shifter (222) interfaces with the carriage or the capping body (270), the rotation of the feedshaft (104) is such that the drag created by the friction finger (230) is overcome. As a result, the feedshaft (104) can still rotate while the shifter (222) is restricted from over-rotating, or rotating past a desired or defined point.

In this example, as the feedshaft (104) rotates clockwise relative to the view depicted in FIGS. 6 and 7, the friction finger (250) creates the drag. As a result, the shifter (222) rotates clockwise due to the drag until the arm (256) of the shifter (222) is in an upright position as indicated by the upwards Z-direction. In one example, the arm (256) of the shifter (222) interfaces with a first portion (257) of the framework of the printing device (100). Once the shifter (222) is in the upright position, the shifter (222) is in the scanning system (160) drive position as depicted in FIGS. 6 and 8. In another example, as the feedshaft (104) rotates counter clockwise, the friction finger (250) again creates drag against the feedshaft (104). As a result, the shifter (222) rotates counter clockwise due to the drag until the arm (256) of the shifter (222) interfaces with the capping body (270). Once the shifter (222) interfaces with the capping body (270), for example, as depicted in FIGS. 4, 5, and 7, the shifter (222) is in the clear position.

The cluster gears (146-1, 146-2) drive the rack (118) from the uncapped position to the capped and scan position. Now that the shifter (222) is blocked by the carriage (206) or other element within the printing device (100), the swing arm interface (212) and the shifter interface (214) interface with each other. Further, the shifter (222) remains in the upright position. The feedshaft (104) can rotate without the drive swing arm (108) rotating. To cap the printheads, the feedshaft (104) rotates counter clockwise relative to the view depicted in FIGS. 6 and 7. As mentioned above, the feedshaft drive gear (220) engages with the cluster gears (146-1, 146-2). Since the feedshaft is rotating counter clockwise, the cluster gears (146-1, 146-2) rotate clockwise relative to the view depicted in FIGS. 6 and 7. The teeth of the cluster gears (146-1, 146-2) engage with the teeth of the rack (118). As the cluster gear (146) engages with the rack (118), the rack (118) moves, as indicated by arrow 601, from the uncapped position of FIG. 7 to the capped and scan position of FIG. 6. The ramp (260) interfaces with the elevator (230), and forces the capping body (270) in an upward direction as indicated by arrow 602 and the positive Z-direction. Thus, as the rack (118) transitions from the uncapped position to the capped and scanning system (160) drive position, the ramp (260) is pushed underneath the elevator (230). This results in the elevator (230) moving upwards in the positive Z-direction. When the elevator (230) is moved upwards, the elevator (230) presses a number of caps (271) against the printheads. The caps (271), being made of an elastomeric material, are compressed against the printheads to provide a seal. As a result, the caps (271) protect the printheads from drying out, from contamination, or combinations thereof.

Conversely, as the rack (118) transitions from the capped and scanning system (160) drive position to the uncapped and printing system (105) drive position, the ramp (260) is removed from underneath the elevator (230). This results in the elevator (230) causing the capping body (270) to move downwards. When the capping body (270) is moved down, the caps (271) of the capping body (270) do not press against the printheads. Since the caps (271) do not push against the printheads, the printheads are uncapped. As a result, the printheads may be used for a print job. In one example, the capping body (270) moves downward at least a distance to allow for the carriage and its printheads to clear the capping body (270) during a printing process.

In preparing to uncap, the cluster gears (146-1, 146-2) drive the rack (118) from the capped and scanning system (160) drive position to the uncapped and printing system (105) drive position. As the feedshaft (104) rotates clockwise relative to the view depicted in FIGS. 6 and 7, the swing arm interface (212) and the shifter interface (214) separate from one another. This causes the drive swing arm (108) to rotate clock wise. As mentioned above, the feedshaft drive gear (220) engages with the cluster gears (146-1, 146-2). In FIG. 6, the second cluster gear (146-2) is meshed with a second idler gear (147-2) after the rack (118) moved to the left as indicated in by arrow 601. Since the feedshaft (104) is rotating clockwise, the cluster gear (146) is caused rotate counter-clockwise.

Figure 10:
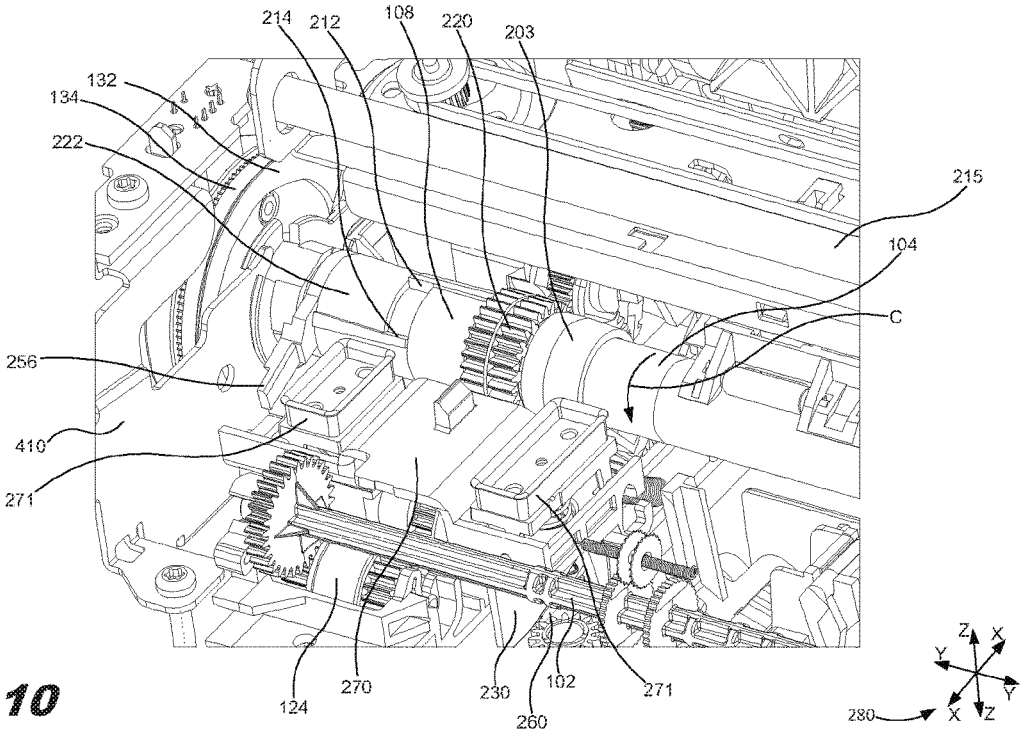
FIG. 10 is a cut-away isometric view of the printing device, according to one example of principles described herein.
Figure 19:
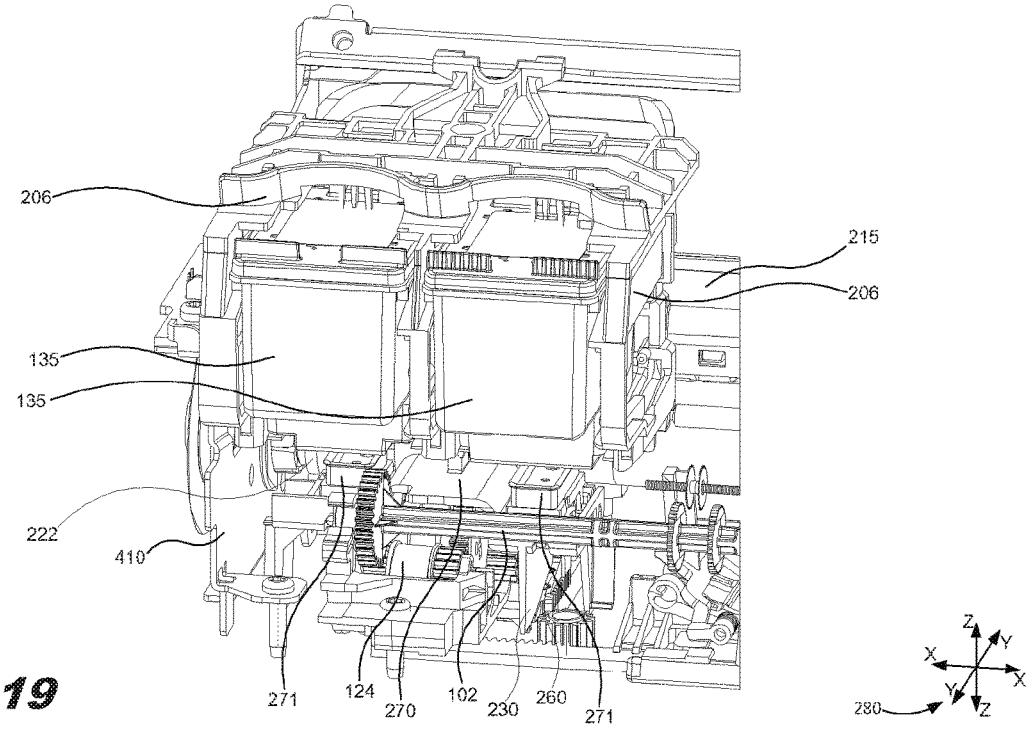
FIGS. 19 through 21 are isometric views of the printing device preparing to print after an uncapping of the printheads, according to one example of principles described herein.
Figure 20:
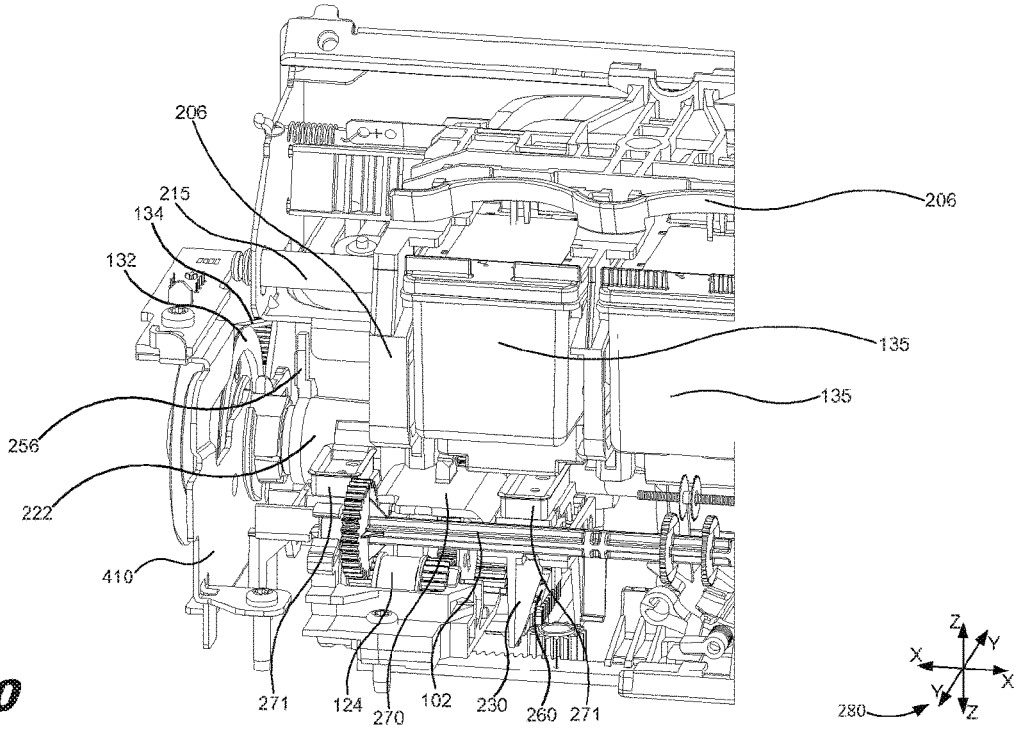
Figure 21:
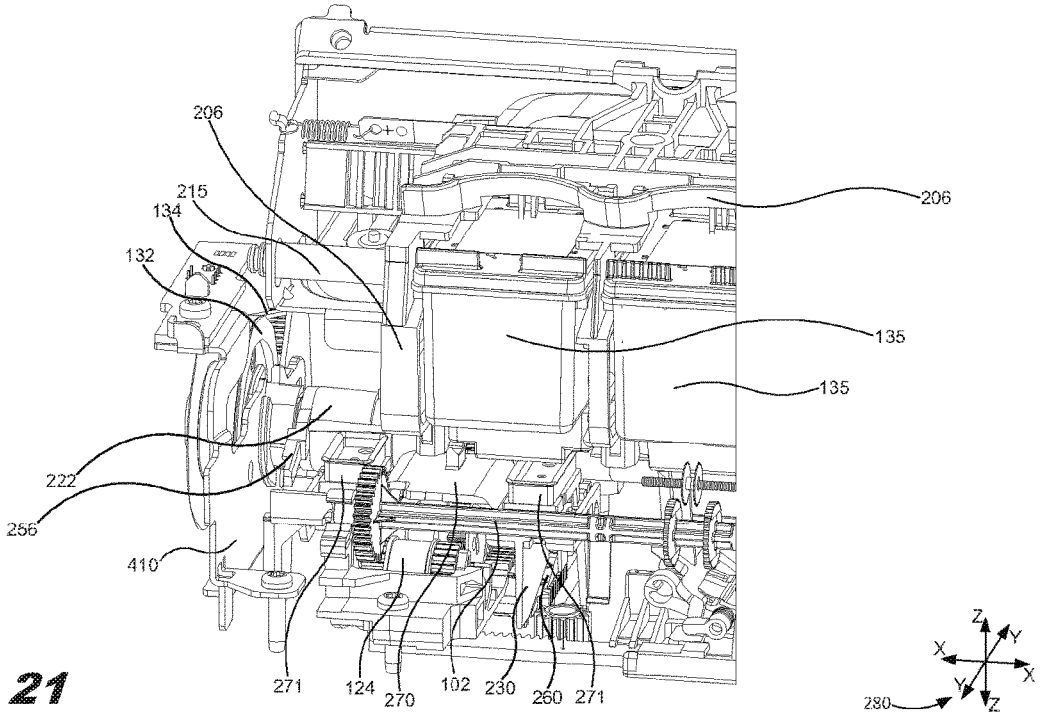

FIG. 10 is a cut-away isometric view of the printing device (100), according to one example of principles described herein. The printing device (100) includes the capping system (122), as mentioned above. The capping system (122) is used to cap and humidically seal a number of printheads (135) coupled to a carriage (206). The carriage (206) and printheads (135) are moved from view in FIG. 10, but are depicted in FIGS. 19 through 21. The capping system (122) includes at least a portion of the rack (118) in that the rack (118) includes a ramp (260) formed therein that interfaces with an elevator (230) formed in a capping body (270). The capping system (122) further includes a number of caps (271) formed on the capping body (270). In one example, the number of caps (271) is equal to the number of printheads (135) that may be coupled to the carriage (206). The ramp (260) formed on the rack (118) of the capping system (122) moves the elevator (230). For example, as the elevator (230) moves in a vertical direction as indicated by arrows 602 and 702 of FIGS. 6 and 7, respectively, as the rack (118) and its ramp (260) move in a horizontal direction as indicated by arrows 601 and 701 in FIGS. 6 and 7, respectively.

In FIG. 10, the shifter (222) is in a printing system (105) drive position or "clear" position wherein the printing device (100) is able to feed print media through the printing device (100) using the output shaft (102). Further, the capping body (270) is not engaged with the printheads (FIGS. 19-21, 258), but is lowered in the Z-direction as indicated by arrow 602 of FIGS. 6 and 7. Still further, in the clear position, the printheads (FIGS. 19-21, 258) are able to move in the X-direction along the carriage rail (215).

Figure 11:
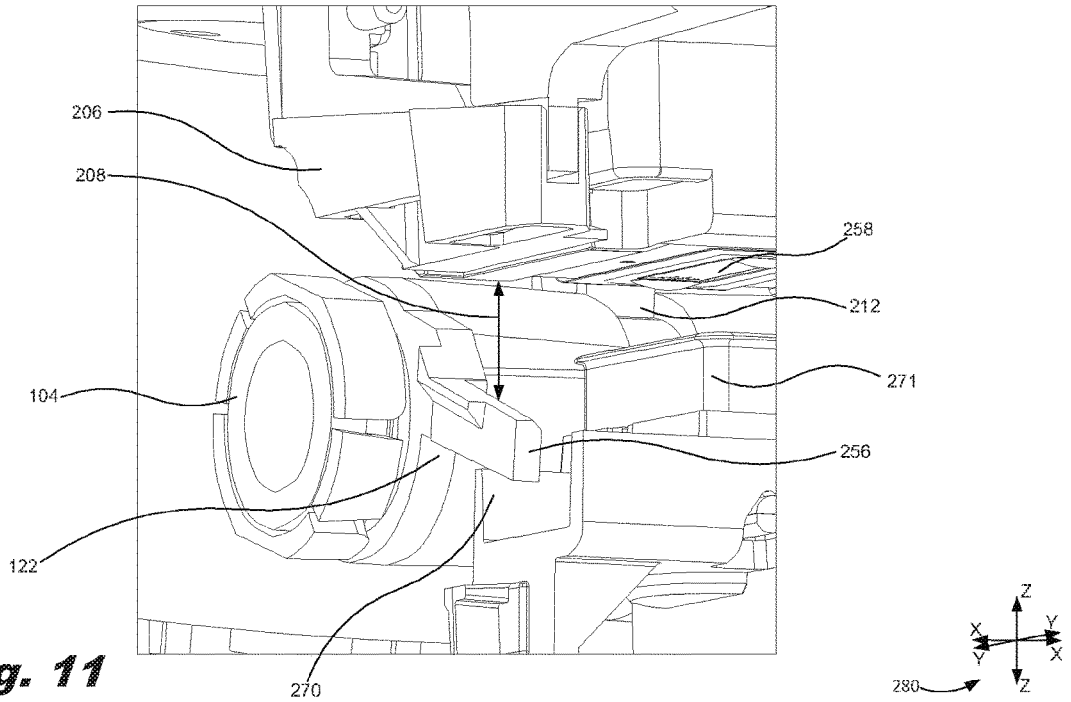
FIG. 11 is an isometric view of a shifter of the printing device depicting a clearance between the shifter and a number of printheads, according to one example of principles described herein.

FIG. 11 is an isometric view of the shifter (222) of the printing device (100) depicting a clearance between the shifter (222) and a number of printheads (135), according to one example of principles described herein. Again, the shifter (222) as depicted in FIG. 11 is in the clear position. In this position, it interfaces with a portion of the printing device (100) including, for example, the capping body (270). This prevents the shifter (222) from continuing to rotate about the feedshaft (104) using the friction finger (250) formed on the shifter (222). When the shifter (222) is in the clear position as depicted in FIG. 11, the shifter (222) does not interface with the carriage (206). As a result, the carriage (206) is free to move along the carriage rail (205) to which the carriage (206) is slidably coupled. The shifter (222) is depicted in the clear position in FIGS. 4, 7, 10, 12, and 21. In the clear position, the arm (256) of the shifter (222) makes contact with the capping body (270) of the capping system (122). However, in another example, the arm (256) of the shifter (222) may make contact with any another portion of the printing device such as a housing or a pillar formed into the printing device for the purpose of stopping the rotation of the shifter (222). As a result, the capping body (270) or another component of the printing device prevents the shifter (222) from rotating past a certain point.

As depicted in FIG. 11, the carriage (206) is at full left position, or, in other words, in the X-direction as indicated by the Cartesian coordinate indicator (280). In the full left position, the carriage (206) makes contact with a left wall (410) of the printing device as depicted in, for example, FIGS. 4, 10, 14, and 19-21. With the shifter (222) in the clear position, the arm (256) of the shifter (222) does not interface with the carriage (206) as indicated by the clearance (208). In some examples, the clearance (208) between the shifter (222) and the carriage (206) is between 2 and 3 millimeters (mm). As a result, the carriage (206) is free to move along a carriage rail (205) in the positive and negative Y-directions via a carriage motor to eject the printing fluid via the printheads (135) onto the print medium to form the image. This provides a printing device (100) that is able to function in a relatively smaller space, which, in turn, provides a smaller product for consumers.

Figure 12:
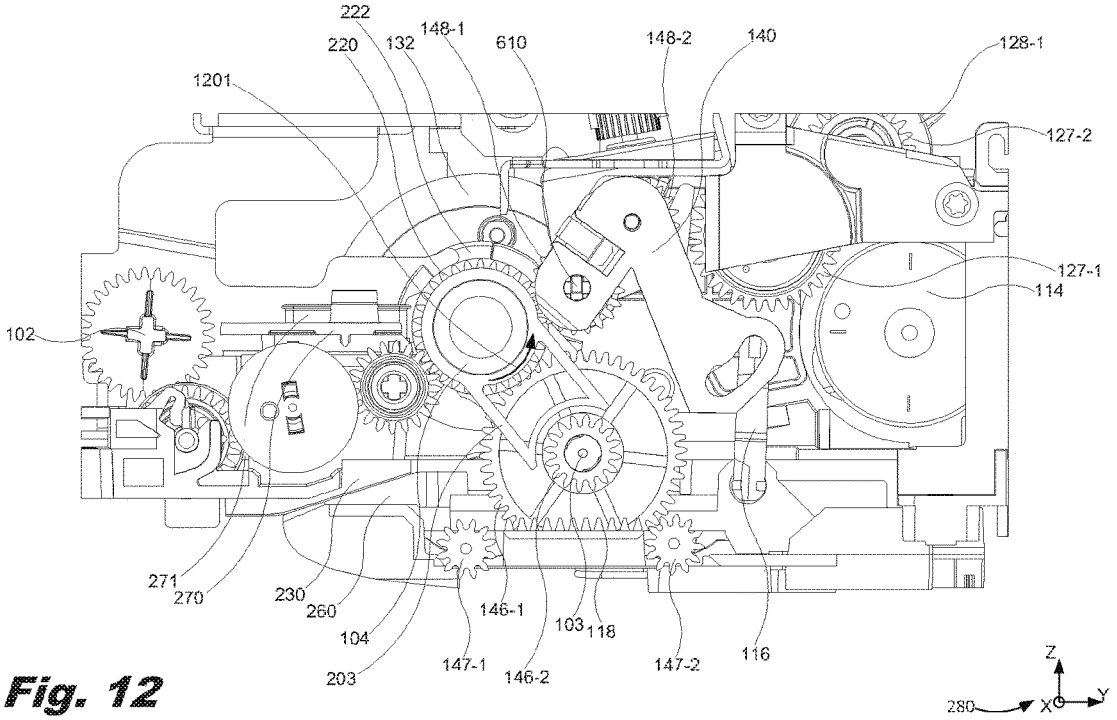
FIG. 12 is a cutaway side view of the printing device depicting the printing device in a printing system drive position, according to one example of principles described herein.

The manner in which the printing device (100) shifts between a printing and uncapped state to a scanning and capped state, and back again, will now be described in connection with FIGS. 12 through 21. FIGS. 12 through 21 depict a series of states the printing device (100) is placed in during the transition between the printing and scanning states. FIG. 12 is a cutaway side view of the printing device (100) depicting the printing device (100) in a printing system (105) drive position, according to one example of principles described herein. In this state, the shifter (222) is in the down or clear position, and the shifter interface (FIG. 4, 214) of the shifter (222) is not interfacing with the swing arm interface (FIG. 4, 212) of the drive swing arm (108).

As a result of the shifter (222) not interfacing with the drive swing arm (108), the cluster gears (146-1, 146-2) are moved in a counter-clockwise direction as indicated by arrow 1201. This is due to the bearing (203) and the drive swing arm (108) rotating in the same direction due to the rotation of the feedshaft (104) in the direction of arrow 1201 as it drives the printing system (105) to move print media through a number of rollers during printing. The movement of the feedshaft in the counter-clockwise direction as indicated by arrow 1201 may be referred to as a "forward" rotational direction of the feedshaft (104).

Further, in the printing and uncapped state depicted in FIG. 12, the cluster gears (146-1, 146-2), and the second cluster gear (146-2), in particular, do not engage with the teeth of the rack (118). This causes the rack (118) to not be in a forward, left-most position relative to the view in FIG. 12, and the capping body (207) is not elevated as may be distinguished between FIG. 12 and FIGS. 17 and 18. This is because the ramp (260) of the rack (118) is not moved to the left and interfacing with the elevator (230) formed in the capping body (270) to force the capping body (270) in the upward direction as indicated by arrow 602 in FIG. 6. Still further, in this state, the second selector gear (148-2) of the selector swing arm (140) is not engaged with the first intermediate gear (127-1) and the remaining movement components of the scanning system (160). Thus, the scanning system (160) is not functioning.

Figure 13:
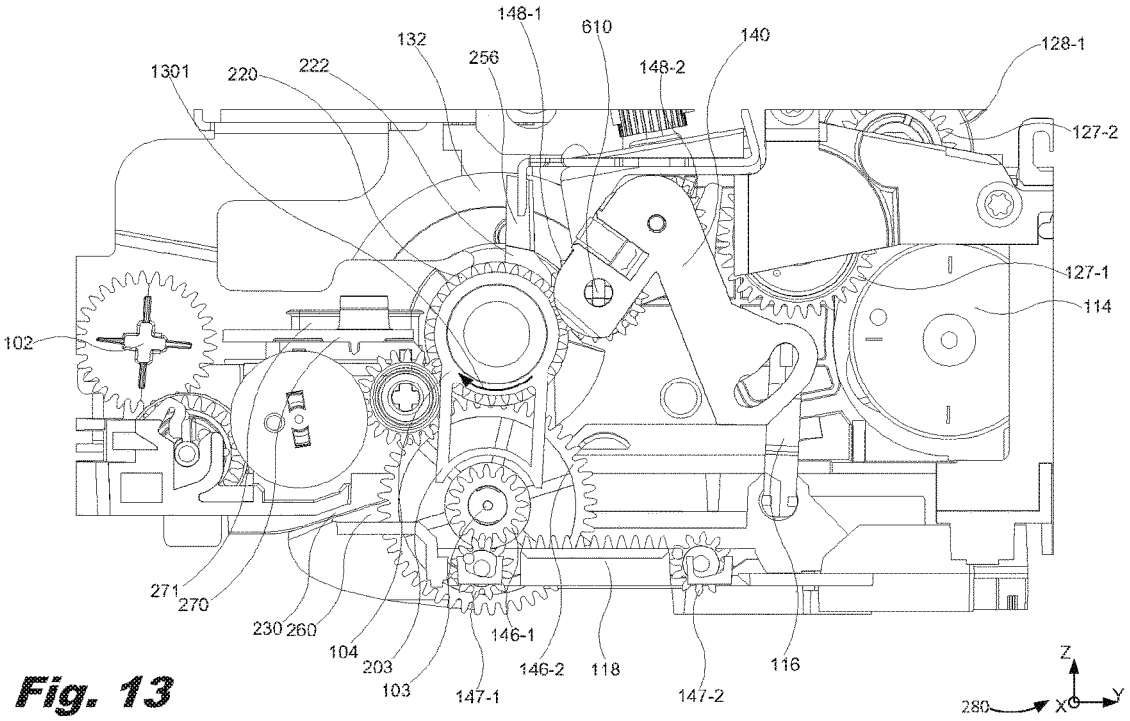
FIG. 13 is a cutaway side view of the printing device depicting the printing device in a position of preparing to cap the printheads, according to one example of principles described herein.

Turning to the next state of the printing device (100), FIG. 13 is a cutaway side view of the printing device (100) depicting the printing device (100) in a position of preparing to cap the printheads (135), according to one example of principles described herein. In this state, the controller (130) instructs the motor (114) to rotate in an opposite rotational direction for a period of time. This causes the feedshaft (104) to rotate in the direction of arrow 1301, and causes the drive swing arm (108) and the bearing (203) to move in the same, clockwise direction. This, in turn, causes the cluster gears (146-1, 146-2) to shift from a right position as depicted in FIG. 12 to a left position as depicted in FIG. 13. In this state, the second cluster gear (146-2) is able to mesh with a first idler gear (147-1) rotatably coupled to the rack (118). Because the second cluster gear (146-2) is meshed with the first idler gear (147-1), and because the first idler gear (147-1) does not drive a shaft to perform any work, the rotation of the cluster gears (146-1, 146-2) imparted by the rotation of the feedshaft drive gear (220) of the feedshaft (104) does not cause movement of any components within the printing device (100). More of the interface between the cluster gears (146-1, 146-2) and the idler gears (147-1, 147-2) and teeth of the rack (118) will be described in more detail below.

Figure 14:
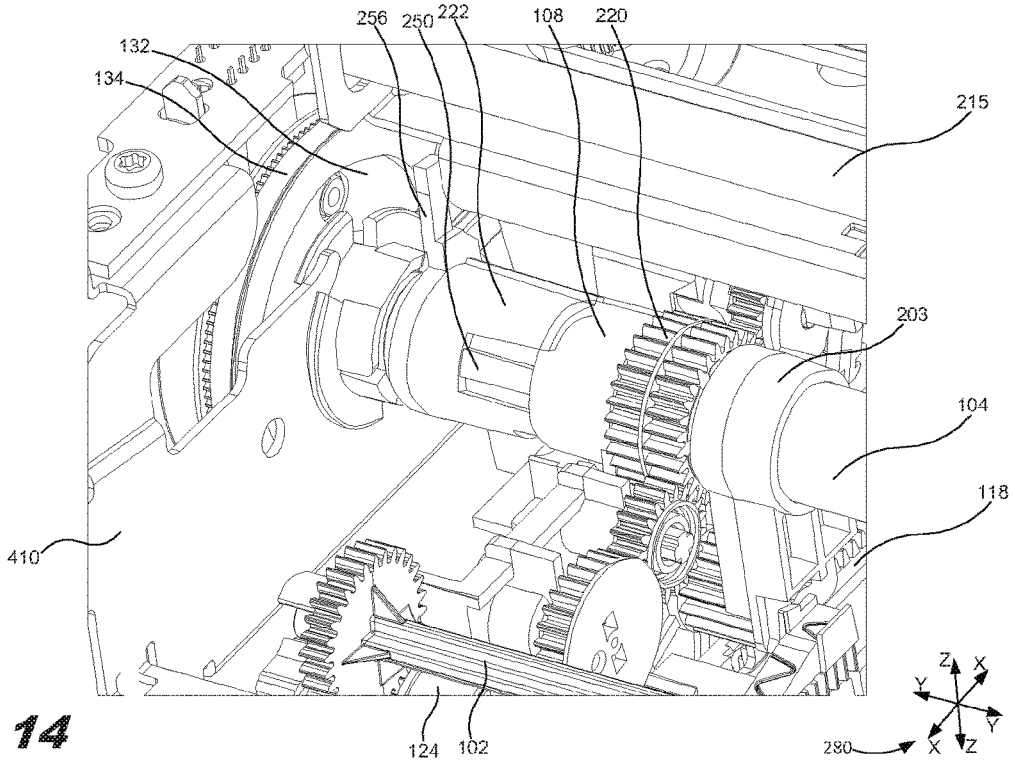
FIG. 14 is a is a cut-away isometric view of the printing device in a position of preparing to cap the printheads, according to one example of principles described herein.

The shifter (222), in FIG. 13, has also changed position relative to the state depicted in FIG. 12. Once the printing device (100) has finished a print job, the printheads (135) of the printing device are capped in order to humidically seal the nozzles of the printheads (135) from contaminants and drying when the printing system (105) of the printing device (100) is not being used to print images on print media. In order to begin capping the printheads (135), the feedshaft (104) rotates clockwise as indicated by arrow 1301. This moves the shifter (222) to the scanning system (160) drive position that causes the motor (114) to drive the scanning system (160). In the scanning system (160) drive position, the drive arm interface (FIG. 4, 212) interfaces with the shifter interface (FIG. 4, 214). This causes the drive swing arm (108) and the bearing (203) to swing clockwise as indicated by arrow 1301 and as described above. The rotational position of the shifter (222) in FIG. 13 is also depicted in more detail in FIG. 14. FIG. 14 is a is a cut-away isometric view of the printing device (100) in a position of preparing to cap the printheads (135), according to one example of principles described herein. From the perspective depicted in FIG. 14, the arm (256) of the shifter (222) is in an up position since the friction finger (250) drags along the feedshaft (104) which is moving in the clockwise or reverse direction. This causes the shifter (222) to rotate in the clockwise or reverse direction as well.

Figure 15:
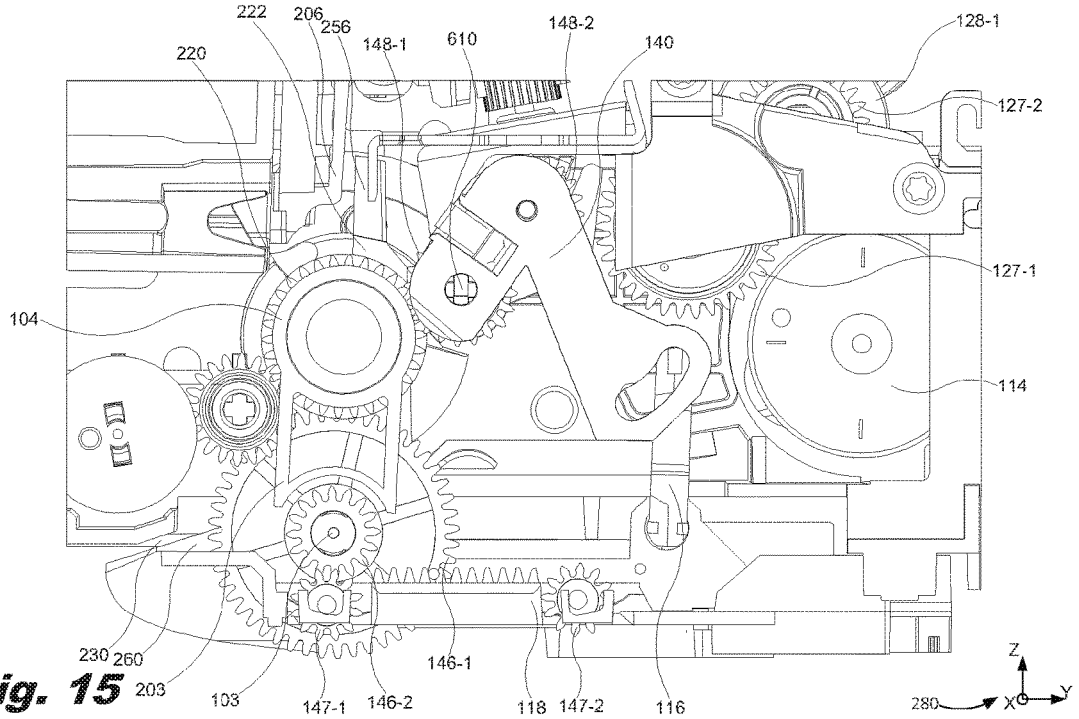
FIG. 15 is a cutaway side view of the printing device depicting the printing device in a position of preparing to cap the printheads, according to one example of principles described herein.

FIG. 15 is a cutaway side view of the printing device (100) depicting the printing device (100) in a position of preparing to cap the printheads (135), according to one example of principles described herein. With the shifter (222) in the up position, the controller (130) controls the movement of the carriage (206) along the carriage rail (FIG. 10, 215) to the left-most wall (410) as depicted in, for example, FIG. 19. In this position, the carriage (206) restricts movement of the shifter (222). The shifter (222) is unable to move in the counter-clockwise direction if and when the feedshaft (104) rotates in the counter-clockwise direction because the carriage (206) is obstructing its rotational movement in that direction. Even though the carriage (206) is used to restrict movement of the shifter (222) any other element within the printing device (100) may engage with the shifter (222) to restrict its movement in this manner. However, in the examples described herein, using the carriage (206) to restrict movement of the shifter (222) eliminates the need for a specialized device that may otherwise take up more space within the printing device (100) or add additional cost to the printing device (100) as a product. Further, the placement of the shifter (222) along the length of the feedshaft (104) and the movement of the carriage (206) to the left-most wall (410) serves to place the printheads (135) coupled to carriage (206) in alignment for capping by the capping body (270) as will now be described.

Figure 16:
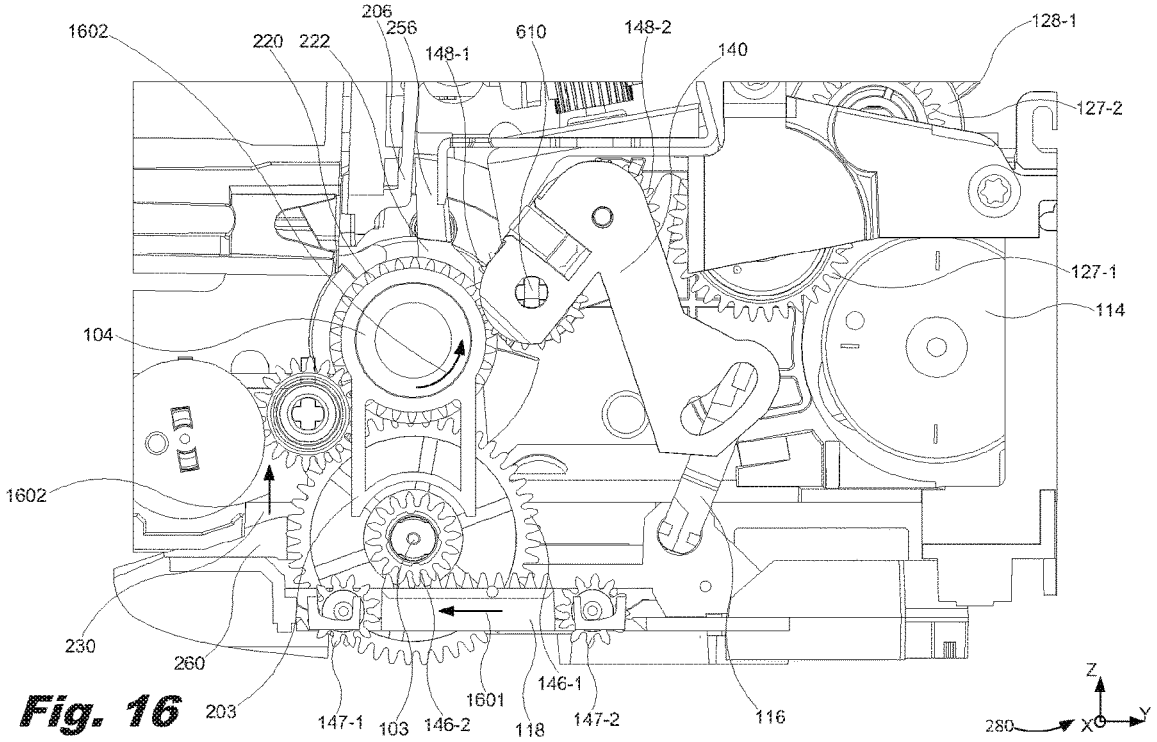
FIG. 16 is a cutaway side view of the printing device depicting the printing device in a capping position, according to one example of principles described herein.

With the printing device (100) in the state depicted in FIG. 15, the printing device (100) is now ready to cap the printheads (135). FIG. 16 is a cutaway side view of the printing device (100) depicting the printing device (100) in a capping position, according to one example of principles described herein. The controller (130), via the motor (114), causes the feedshaft (104) to rotate in the direction indicated by arrow 1602. With the friction finger (250) ensuring that the shifter (222) biases itself in the direction of rotation of the feedshaft (104), the shifter (222) rotates with the feedshaft (104) a relatively shorter distance until it interfaces with the carriage (206). In this manner, the carriage (206) restricts the rotational movement of the shifter (222) with the feedshaft (104) during a capping process and during the driving of the scanning system (160).

This, in turn, causes the swing arm interface (212) and the shifter interface (214) to remain interfaced with each other effectively ensuring that the drive swing arm (108) and bearing (203) remain in the left position rather than the right position depicted in, for example, FIG. 12. As depicted in FIG. 16, the second cluster gear (146-2) disengages from the first idler gear (147-1) and begins to mesh with the rack (118). The first cluster gear (146-1) is always engaged with the feedshaft drive gear (220), and, therefore, whenever the feedshaft (104) and the feedshaft drive gear (220) are rotating, the cluster gears (146-1, 146-2) are rotating.

In FIG. 16, the capping of the printheads (135) is beginning by the ramp (260) coupled to or formed in the rack (118) interfacing with the elevator (230) coupled to or formed in the capping body (270). Because the ramp (260) and the elevator (230) have opposite and opposing angles, movement of the rack (118) to the left as indicated by arrow 1601 causes the elevator to move upward as indicated by arrow 1602.

Figure 17:
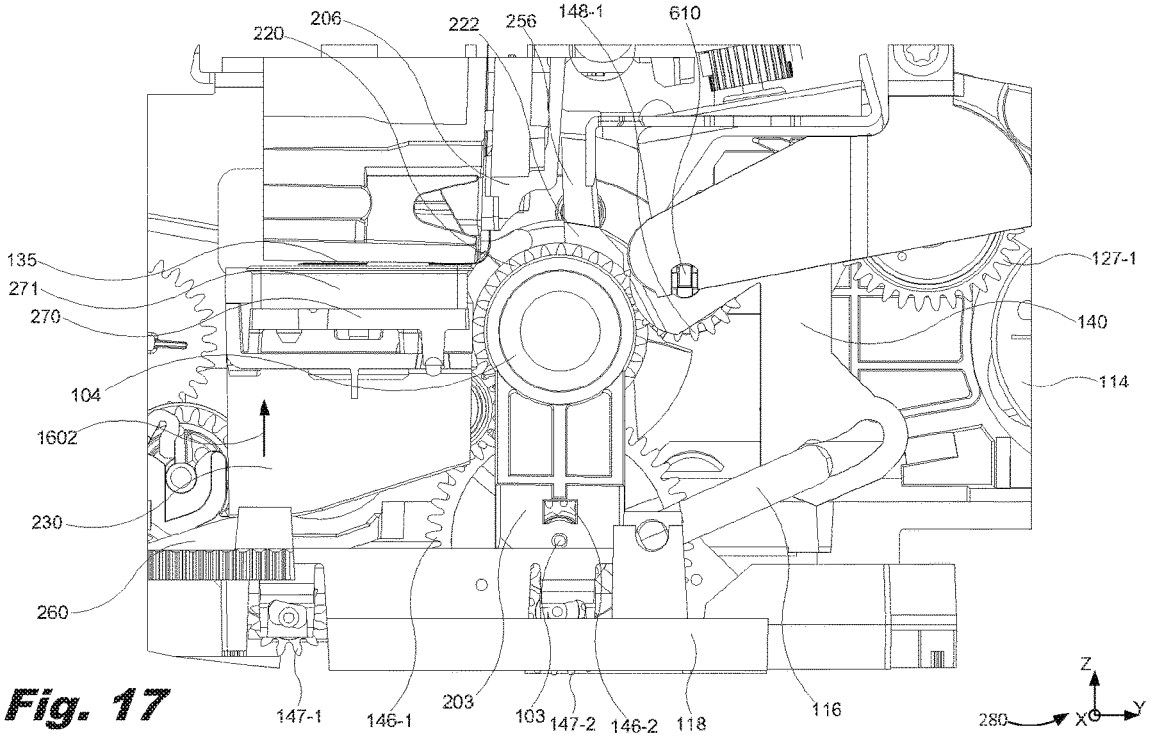
FIG. 17 is a cutaway side view of the printing device depicting the printing device in a capped position, according to one example of principles described herein.

The cluster gears (146-1, 146-2) continue to drive the rack (118) to the left, and the ramp (260) continues to drive the capping body (270) upward via the elevator (230). Once the end of the rack (118) has been reached, the printing device (100) is placed in the state depicted in FIG. 17. FIG. 17 is a cutaway side view of the printing device (100) depicting the printing device (100) in a capped position, according to one example of principles described herein. The capped position is the position in which the caps (271) formed on the capping body (270) are covering and sealing the printheads (135).

Further, as described above, the drive selector system (150) includes a connector arm (116) pivotally connected to the rack (118) and to the selector swing arm (140). While the rack (118) is driven by the cluster gears (146-1, 146-2) as described above in connection with FIG. 16, the rack (118) also pulls the selector swing arm (140) into engagement with the scanning system (160) so that the scanning system (160) may function. Specifically, the first selector gear (148-1) is always meshed with the feedshaft drive gear (220) of the feedshaft (104). When the selector swing arm (140) is not engaged with the scanning system (160), the second selector gear (148-2) is in neutral in that the second selector gear (148-2) rotates without engagement with another gear. However, once the rack (118) also pulls the selector swing arm (140) into engagement with the scanning system (160), the second selector gear (148-2) meshes with the first intermediate gear (127-1) of the scanning system (160). This, in turn, provides the torque and power to drive the scanning system (160) as described above.

Also depicted in FIG. 17 is the infinite nature of the rack (118) due to the inclusion of the idler gears (147-1, 147-2). Once the second cluster gear (146-2) reaches either end of the rack (118), it disengages from the teeth of the rack (118), and engages with one of the idler gears (147-1, 147-2). Since the cluster gears (146-1, 146-2) are continually driven by the feedshaft drive gear (220), the continual rotation of the cluster gears (146-1, 146-2) is addressed using the idler gears (147-1, 147-2) wherein the cluster gears (146-1, 146-2) are in neutral and idle once engaged with the idler gears (147-1, 147-2). In this sense, the rack (118) with its idler gears (147-1, 147-2) form an infinite rack.

Figure 18:
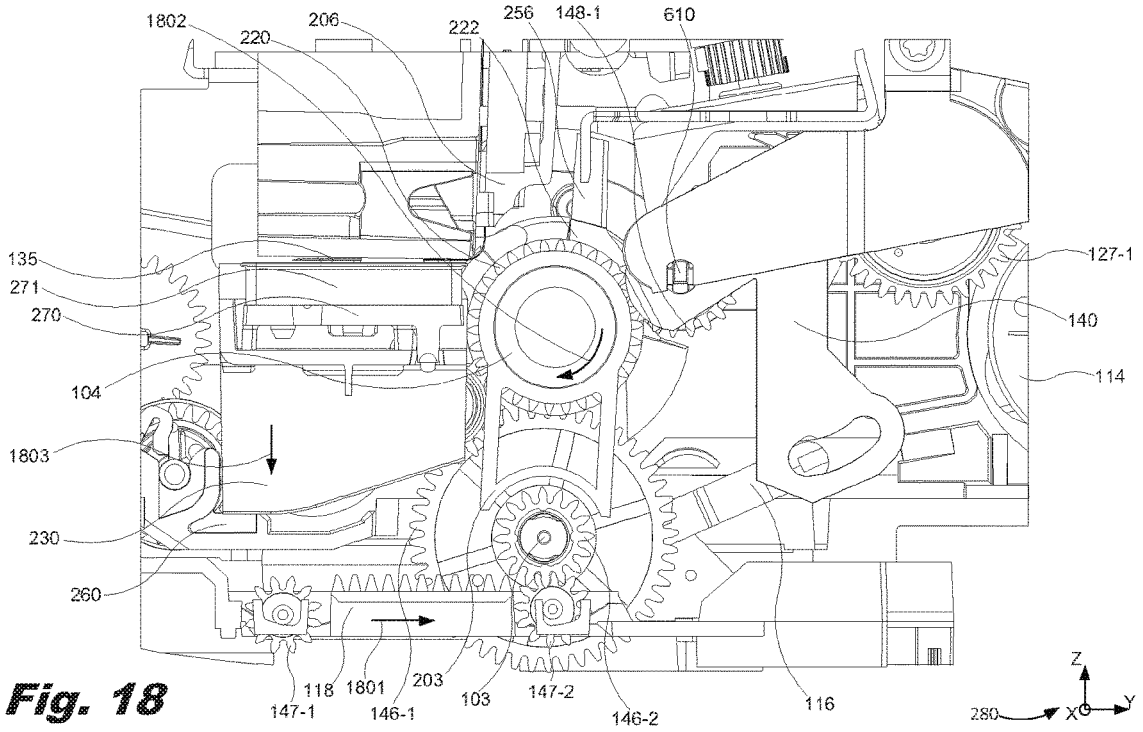
FIG. 18 is a cutaway side view of the printing device depicting the printing device in a position of preparing to uncap the printheads, according to one example of principles described herein.

In the state depicted in FIG. 17, the printing device (100) is ready to scan documents using the scanning system (160). The transition back to the printing functionality of the printing device (100) using the printing system (105) will now be described in connection with FIGS. 18-21. FIG. 18 is a cutaway side view of the printing device (100) depicting the printing device in a position of preparing to uncap the printheads (135), according to one example of principles described herein. FIGS. 19 through 21 are isometric views of the printing device (100) preparing to print after an uncapping of the printheads (135), according to one example of principles described herein. As depicted in FIG. 18, the controller (130) causes the feedshaft (104) to rotate in the clockwise direction as indicated by arrow 1802. The shifter (222) moves in the same direction and no longer touches the carriage (206) as it did before in FIG. 17. Further, the rotation of the feedshaft (104) in the clockwise direction also causes the cluster gears (146-1, 146-2) to begin to rotate, disengage from the second idler gear (147-2), and begin to engage with the teeth of the rack (118).

FIG. 19 depicts the printing device (100) at the beginning of the transition from the scanning system (160) drive position to the printing system (105) drive position. FIG. 20 depicts the movement of the carriage (206) from the leftmost wall (410) to a clear position were the arm (256) of the shifter (222) is able to be moved from the up position to a down position. The position of the arm (256) of the shifter (222) is that position depicted in FIG. 18 where the shifter (222) no longer touches the carriage (206).

In FIG. 20, the shifter (222) is rotated along with the feedshaft (104) to the down and clear position described above in connection with FIG. 12, above. In this position, the shifter interface (FIG. 4, 214) of the shifter (222) is interfacing with the swing arm interface (FIG. 4, 212) of the drive swing arm (108). Turning again to FIG. 18, the cluster gears (146-1, 146-2) are able to pull the rack (118) to the right as indicated by arrow 1801. By pulling the rack (118) to the right as depicted in FIG. 18, the ramp (260) slides out from under the elevator (230), the caps (271) disengaged from the printheads (135) and the capping body (270) is lowered away from the printheads (135) as indicated by arrow 1803.

Further, with the movement of the rack (118) to the right, the rack (118) pushes the connector arm (116), which, in turn, pushes the selector swing arm (140) up and disengages the second selector gear (148-2) from the first intermediate gear (127-1). Thus, once the printing device (100) moves from the scanning system (160) drive position to the printing system (105) drive position, the scanning system (160) is no longer mechanically coupled to the feedshaft, and the printing device (100) can no longer feed documents through the scanning system (160). As the printing device (100) progresses through FIGS. 18 through 21, the printing device (100) is placed back into the state as that found in FIG. 12 where the printing device (100) is in a printing system (105) drive position. The transition between these states may be performed any number of times to provide both printing and scanning functionality.

Figure 22:
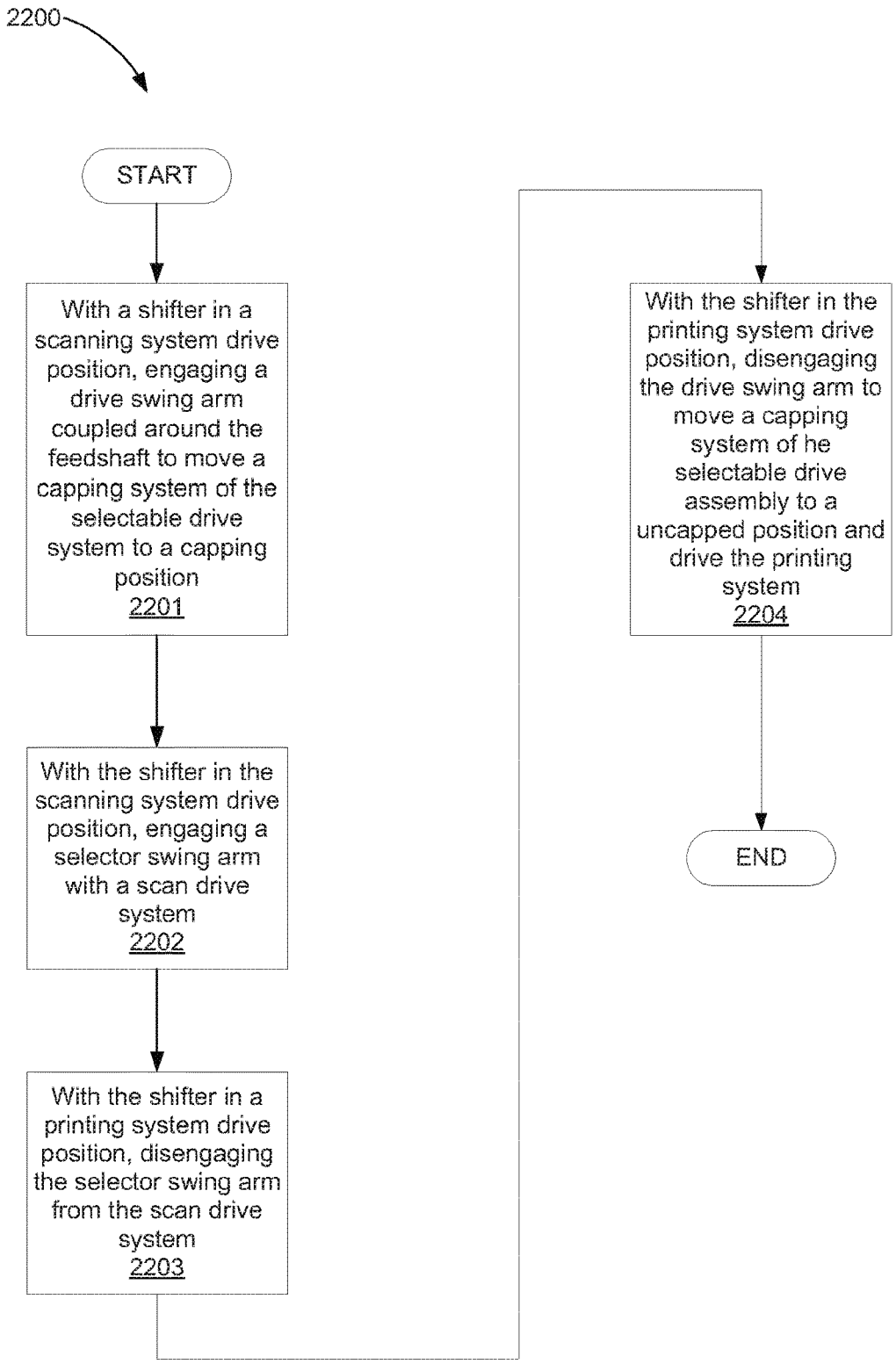
FIG. 22 is a flowchart depicting a method for driving a selectable drive system of a printing device, according to one example of principles described herein.

FIG. 22 is a flowchart depicting a method for driving a selectable drive system of a printing device (100), according to one example of principles described herein. The method (2200) may begin by, with the shifter (222) coaxially and rotatably coupled around the feedshaft (104) and in a scanning system drive position, engaging (block 2201) the drive swing arm (108) coupled around the feedshaft (104) to move the capping system of the selectable drive system to a capping position. With the shifter (222) in the scanning system drive position, the printing device (100) engages (block 2202) the selector swing arm (140) with a scan drive system. The method may further include, with the shifter (222) in a printing system (105) drive position, disengaging (block 2203) the selector swing arm (140) from the scan drive system, and disengaging (block 2204) the drive swing arm (108) to move the capping system of the selectable drive system to an uncapped position and drive the printing system (105). In one example, moving the capping system of the selectable drive system to a capping position includes, with a cluster gear meshed with a drive gear coupled to the feedshaft, engaging a rack to move the rack in a horizontal direction, and with a ramp of the rack, interfacing an oppositely angled elevator of a capping body as the rack moves in the horizontal direction to move the capping body in a vertical direction.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the controller (130) of the printing device (100) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a selectable drive printing device. The selectable drive printing device includes a feedshaft to selectively drive a print drive system and a scan drive system, and a shifter to selectively shift a drive selector assembly of the selectable drive printing device between a scanning system drive position wherein the scan drive system is driven and a printing system drive position wherein the print drive system is driven. The shifter is coaxially and rotatably coupled around the feedshaft. Further, the shifter selectively drives the print drive system and the scan drive system based on an angular position of the shifter about the feedshaft. This selectable drive printing device (1) provides for a printing device that costs less to manufacture and reduces costs to consumers; (2) uses fewer motors reducing the use of resources; and (3) provides for a printing device that has a smaller footprint and weighs less, among other characteristics.

The preceding description has been presented to illustrate and describe examples of the principles described. This description is not intended to be exhaustive or to limit these principles to any precise form disclosed. Many modifications and variations are possible in light of the above teaching.

What is claimed is:

1. A selectable drive printing device comprising:

a feedshaft to selectively drive a print drive system and a scan drive system; and a shifter to selectively shift a drive selector assembly of the selectable drive printing device between a scanning system drive position wherein the scan drive system is driven and a printing system drive position wherein the print drive system is driven, wherein the shifter is coaxially and rotatably coupled around the feedshaft, and wherein the shifter selectively drives the print drive system and the scan drive system based on an angular position of the shifter about the feedshaft.

2. The selectable drive printing device of claim 1, wherein the shifter comprises a friction finger formed on the shifter to bias the shifter in a rotational direction of the feedshaft.

3. The selectable drive printing device of claim 2, wherein the selection between the scanning system drive position and the printing system drive position is based at least partially on the rotational direction of the feedshaft effecting a rotational position of the shifter about the feedshaft.

4. The selectable drive printing device of claim 3, further comprising a controller to control the operation of the selectable drive printing device, wherein the rotational direction of the feedshaft is controlled by the control controlling a motor mechanically coupled to the feedshaft.

5. The selectable drive printing device of claim 1, wherein the shifter comprises an arm, wherein the arm interfaces with a carriage of the selectable drive printing device to restrict a rotational position of the shifter in the scanning system drive position.

6. The selectable drive printing device of claim 1, wherein the arm of the shifter interfaces with a capping system of the selectable drive printing device to restrict a rotational position of the shifter in the printing system drive position.

7. A drive selector assembly for selecting between driving a print drive system and driving a scan drive system comprising:

a feedshaft; and a shifter coaxially and rotatably coupled around the feedshaft, the shifter to, based on an angular position of the shifter about the feedshaft, selectively shift the drive selector assembly between a scanning system drive position wherein a scan drive system is driven and a printing system drive position wherein a print drive system is driven.

8. The drive selector assembly of claim 7, further comprising:

a selector swing arm comprising:

a first selector gear meshed with a drive gear coupled to the feedshaft;

a second selector gear; and a pivot, wherein the selector swing arm pivots about the pivot to selectively mesh with a scan drive gear of the scan drive system.

9. The drive selector assembly of claim 7, further comprising:

a cluster gear comprising:

a first cluster gear meshed with the feedshaft; and a second cluster gear selectively meshed with a rack, the rack to actuate a capping system to cap a number of printheads;

a number of idler gears rotatably coupled to the rack to idle the cluster gear when the cluster gear reaches an end of the rack.

10. The drive selector assembly of claim 8, wherein the first selector gear is continually meshed with the drive gear.

11. The drive selector assembly of claim 9, wherein the first cluster gear is continually meshed with the drive gear.

12. The drive selector assembly of claim 7, further comprising a drive swing arm coaxially and rotatably coupled around the feedshaft, wherein the drive swing arm interfaces with the shifter to move a capping system into a capping position when the shifter is in the scanning system drive position.

13. A method for driving a selectable drive system of a printing device, the method comprising:

with a shifter coaxially and rotatably coupled around a feedshaft and in a scanning system drive position:

engaging a drive swing arm coupled around the feedshaft to move a capping system of the selectable drive system to a capping position; and engaging a selector swing arm with a scan drive system; and with the shifter in a printing system drive position;

disengaging the selector swing arm from the scan drive system;

disengaging the drive swing arm to move a capping system of the selectable drive system to an uncapped position and drive the printing system.

14. The method of claim 13, wherein moving the capping system of the selectable drive system to a capping position comprises:

with a cluster gear meshed with a drive gear coupled to the feedshaft, engaging a rack to move the rack in a horizontal direction; and with a ramp of the rack, interfacing an oppositely angled elevator of a capping body as the rack moves in the horizontal direction to move the capping body in a vertical direction.

* * * * *